US005492803A

United States Patent [19]

Landgrebe et al.

[11] Patent Number: 5,492,803

[45] Date of Patent: Feb. 20, 1996

[54] HYDRAZIDE REDOX-DYE-RELEASING COMPOUNDS FOR PHOTOTHERMOGRAPHIC ELEMENTS

[75] Inventors: Kevin D. Landgrebe, Woodbury; Doreen C. Lynch, Afton; Sharon M. Simpson, Lake Elmo, all of Minn.; Justine A. Mooney, Lakeway, Tex.; Andrew W. Mott, Bishops Stortford, England; Duncan M. A. Grieve, Saffron Walden, England; John H. A. Stibbard, Harlow, England; Robert J. D. Nairne, Bishops Stortford, England; Stephen S. C. Poon, Great Dunmow, England; David C. Bays, Loughton, England

[73] Assignee: Minnesota Mining and Manufacturing Company, St. Paul, Minn.

[21] Appl. No.: 369,916

[22] Filed: Jan. 6, 1995

[51] Int. Cl.[6] ..... G03C 1/498

[52] U.S. Cl. ..... 430/619; 430/203; 430/223; 430/351

[58] Field of Search ..... 430/203, 223, 430/619, 351

[56] References Cited

U.S. PATENT DOCUMENTS

| | | | |
|---|---|---|---|
| 1,623,499 | 4/1927 | Sheppard et al. | 96/107 |
| 2,131,038 | 9/1938 | Brooker et al. | 95/7 |

(List continued on next page.)

FOREIGN PATENT DOCUMENTS

| | | |
|---|---|---|
| 35262 | 9/1981 | European Pat. Off. . |
| 311009 | 4/1989 | European Pat. Off. . |
| 244399 | 5/1990 | European Pat. Off. . |
| 509740 | 10/1992 | European Pat. Off. . |
| 49-13224 | 2/1974 | Japan . |
| 50-17216 | 2/1975 | Japan . |
| 51-42529 | 4/1976 | Japan . |
| 63-113455 | 5/1988 | Japan . |
| 4-19646 | 1/1992 | Japan . |
| 4-62544 | 2/1993 | Japan . |
| 623448 | 5/1949 | United Kingdom . |
| 837095 | 6/1960 | United Kingdom . |
| 955061 | 4/1964 | United Kingdom . |
| 998949 | 7/1965 | United Kingdom . |
| 1326889 | 8/1973 | United Kingdom . |
| 1417586 | 12/1975 | United Kingdom . |
| 2100016 | 12/1982 | United Kingdom . |
| 9404805 | 3/1994 | United Kingdom . |
| 90/00978 | 2/1990 | WIPO . |

OTHER PUBLICATIONS

J. Bailey et al., "The Photographic Color Development Process" in *The Chemistry of Synthetic Dyes;* K. Venkataraman, Ed.; *Academic Press:* New York; vol. IV, Chapter VI; pp. 341–387 (1971).

G. H. Brown et al., "Azomethine Dyes. II. Color and Constitution of Acylacetamide Azomethine Dyes", *J. Am. Chem. Soc.,* 79, 2919–2927 (Jun. 5, 1957).

D. R. Cassady et al., "Sulfonylureas and Related Compounds", *J. Org. Chem.,* 23, 923–926 (Jun. 1958).

L. J. Fleckenstein, "Color Forming Agents" in *The Theory of the Photographic Process:* T. H. James et al. (Eds.); Macmillan Publishing Co. Inc.: New York, N.Y.; Fourth Edition; pp. 353–354 (1977).

J. M. Harbison et al., "Chemical Sensitization and Environmental Effect", in *The Theory of the Photographic Process;* T. H. James et al. (Eds); Macmillian Publishing Co., Inc.: New York, N.Y.; Fourth Edition, Chapter 5; pp. 149–169 (1977).

J. P. Kitchin et al., "Hydazine–Promoted Infectious Development of Silver Halide—An Improved Process", *J. Imag. Tech.,* 15, 282–284 (Dec. 1989).

D. J. Savage, "Synthesis and Polymerization of Dimethylaminophenyl Isocyanates" *Polymer Letters,* 12, 529–533 (1974).

G. L. Stahl et al., "General Procedure for the Syunthesis of Mono–N–Acylated 1,6–Diaminohexanes", *J. Org. Chem.,* 43, 2285–2286 (1978).

H. Ulrich et al., "New Methods of Preparative Organic Chemistry VI", *Angew. Chem. Internat. Edit.,* 5, 704–712 (1966).

R. F. Bridger et al., "Directive Effects in the Attack of Phenyl Radicals on Carbon–Hydrogen Bonds," *J. Am. Chem. Soc., 85, 3754–3765 (Dec. 5, 1963).*

E. Brinckman et al., "Reduction of a sensitized silver soap" in *Unconventional Imaging Processes; Focal Press: London; pp. 74–75; 1978.*

"Carbamoyloxy substituted couplers in a photothermographic elements and process", *Research Discloure,* No. 23419, pp. 314–315, Oct. 1983.

(List continued on next page.)

*Primary Examiner*—Charles L. Bowers, Jr.
*Assistant Examiner*—Mark F. Huff
*Attorney, Agent, or Firm*—Gary L. Griswold; Walter N. Kirn; Gregory A. Evearitt

[57] ABSTRACT

A photothermographic element comprising a support bearing at least one heat-developable, photosensitive, image-forming photothermographic emulsion layer comprising:

(a) a photosensitive silver halide;

(b) a non-photosensitive, reducible source of silver;

(c) a reducing agent for the non-photosensitive reducible silver source; and (d) a binder;

wherein the reducing agent is a hydrazide redox-dye-releasing compound of the general formulae:

$$R^1\text{+C(O)—NH—NH—SO}_2\text{—X—D]}_n \text{ or}$$

$$\text{[D—X—C(O)—NH—NH—SO}_2\text{]}_n R^2$$

wherein: D represents the chromophore of a thermally mobile dye; X represents a single bond or a divalent linking group; $R^1$ and $R^2$ independently represent an organic group; and $n \geqq 1$.

20 Claims, No Drawings

U.S. PATENT DOCUMENTS

| | | | |
|---|---|---|---|
| 2,274,782 | 3/1942 | Gáspár | 95/2 |
| 2,399,083 | 4/1946 | Waller et al. | 95/7 |
| 2,410,644 | 11/1946 | Flerke et al. | 430/354 |
| 2,444,605 | 7/1948 | Heimbach et al. | 95/7 |
| 2,489,341 | 11/1949 | Waller et al. | 95/7 |
| 2,527,583 | 10/1950 | Silberstein et al. | 95/2 |
| 2,565,418 | 8/1951 | Yackel et al. | 95/7 |
| 2,566,263 | 8/1951 | Trivelli et al. | 95/7 |
| 2,588,765 | 3/1952 | Robijns et al. | 95/9 |
| 2,597,915 | 5/1952 | Yutzy et al. | 95/7 |
| 2,614,928 | 10/1952 | Yutzy et al. | 95/7 |
| 2,618,556 | 11/1952 | Hewitson et al. | 95/7 |
| 2,681,294 | 6/1954 | Beguin | 117/34 |
| 2,694,716 | 11/1954 | Allen et al. | 260/304 |
| 2,701,245 | 2/1955 | Lynn | 260/89.5 |
| 2,728,663 | 12/1955 | Allen et al. | 95/7 |
| 2,761,791 | 9/1956 | Russell | 117/34 |
| 2,839,405 | 6/1958 | Jones | 96/107 |
| 2,886,437 | 5/1959 | Piper | 96/66 |
| 2,956,879 | 10/1960 | Van Campen | 96/74 |
| 2,960,404 | 11/1960 | Milton et al. | 96/94 |
| 2,992,101 | 7/1961 | Jelley et al. | 96/23 |
| 3,080,254 | 3/1963 | Grant, Jr. | 117/36.8 |
| 3,121,060 | 2/1964 | Duane | 252/56 |
| 3,180,731 | 4/1965 | Roman et al. | 96/29 |
| 3,206,312 | 9/1965 | Sterman et al. | 96/87 |
| 3,220,839 | 11/1965 | Herz et al. | 96/61 |
| 3,220,846 | 11/1965 | Tinker et al. | 430/179 |
| 3,241,969 | 3/1966 | Hart et al. | 96/94 |
| 3,253,921 | 5/1966 | Sawdey | 96/73 |
| 3,282,699 | 11/1966 | Jones et al. | 96/84 |
| 3,287,135 | 11/1966 | Anderson et al. | 96/87 |
| 3,297,446 | 1/1967 | Dunn | 96/107 |
| 3,297,447 | 1/1967 | McVeigh | 96/109 |
| 3,330,663 | 7/1967 | Weyde et al. | 96/94 |
| 3,428,451 | 2/1969 | Trevoy | 96/1 |
| 3,432,300 | 3/1969 | Lestina et al. | 96/74 |
| 3,457,075 | 7/1969 | Morgan et al. | 96/67 |
| 3,506,444 | 4/1970 | Haist et al. | 430/352 |
| 3,531,286 | 9/1970 | Renfrew | 96/67 |
| 3,573,050 | 3/1971 | Brannock et al. | 96/84 |
| 3,574,627 | 4/1971 | Stern et al. | 96/100 |
| 3,667,958 | 6/1972 | Evans | 96/114.1 |
| 3,698,909 | 10/1972 | Lestina et al. | 430/372 |
| 3,700,458 | 10/1972 | Lindholm | 96/114.1 |
| 3,719,495 | 3/1973 | Lea | 96/225.2 |
| 3,761,270 | 9/1973 | deMauriac et al. | 96/77 |
| 3,764,337 | 10/1973 | Arai et al. | 96/100 |
| 3,782,949 | 1/1974 | Olivares et al. | 96/76 R |
| 3,785,830 | 1/1974 | Sullivan et al. | 96/114.1 |
| 3,839,049 | 10/1974 | Simons | 96/114.6 |
| 3,844,785 | 10/1974 | Puschel et al. | 430/223 |
| 3,847,612 | 11/1974 | Winslow | 96/67 |
| 3,880,658 | 4/1975 | Lestina et al. | 430/224 |
| 3,985,565 | 10/1976 | Gabrielsen et al. | 96/114.1 |
| 4,021,240 | 5/1977 | Cerquone et al. | 96/29 D |
| 4,021,250 | 5/1977 | Sashihara et al. | 430/619 |
| 4,022,617 | 5/1977 | McGuckin | 96/29 D |
| 4,042,394 | 8/1977 | Smith, Jr. et al. | 96/56 |
| 4,055,428 | 10/1977 | Koyama et al. | 96/73 |
| 4,060,420 | 11/1977 | Merkel et al. | 96/114.1 |
| 4,076,539 | 2/1978 | Ikenoue et al. | 96/114.5 |
| 4,088,496 | 5/1978 | Merkel | 96/114.1 |
| 4,123,274 | 10/1978 | Knight et al. | 96/66 T |
| 4,123,282 | 10/1978 | Winslow | 96/114.1 |
| 4,187,108 | 2/1980 | Willis | 430/203 |
| 4,220,709 | 9/1980 | deMauriac | 430/353 |
| 4,260,677 | 4/1981 | Winslow et al. | 430/618 |
| 4,336,322 | 6/1982 | Fujita et al. | 430/242 |
| 4,368,247 | 1/1983 | Fletcher, Jr. et al. | 430/17 |
| 4,374,921 | 2/1983 | Frenchik | 430/338 |
| 4,386,150 | 5/1983 | Herchen et al. | 430/222 |
| 4,426,441 | 1/1984 | Adin et al. | 430/351 |
| 4,455,363 | 6/1984 | Naito et al. | 430/203 |
| 4,460,681 | 7/1984 | Frenchik | 430/502 |
| 4,463,079 | 7/1984 | Naito et al. | 430/203 |
| 4,469,773 | 9/1984 | Adin et al. | 430/222 |
| 4,473,631 | 9/1984 | Hirai et al. | 430/203 |
| 4,474,857 | 10/1984 | Vaughn, Jr. | 428/446 |
| 4,474,867 | 10/1984 | Naito et al. | 430/203 |
| 4,499,180 | 2/1985 | Hirai et al. | 430/559 |
| 4,511,650 | 4/1985 | Hirai et al. | 430/559 |
| 4,563,415 | 1/1986 | Brown et al. | 430/340 |
| 4,594,307 | 6/1986 | Ishida | 430/203 |
| 4,619,884 | 10/1986 | Singer | 430/223 |
| 4,619,892 | 10/1986 | Simpson et al. | 430/505 |
| 4,622,395 | 11/1986 | Bellus et al. | 544/37 |
| 4,656,124 | 4/1987 | Komamura | 430/548 |
| 4,670,374 | 6/1987 | Bellus et al. | 430/505 |
| 4,708,928 | 11/1987 | Geisler | 430/619 |
| 4,710,570 | 12/1987 | Thien | 544/31 |
| 4,731,321 | 3/1988 | Sato et al. | 430/559 |
| 4,735,884 | 4/1988 | Tsukahara et al. | 430/138 |
| 4,761,361 | 8/1988 | Ozaki et al. | 430/203 |
| 4,772,531 | 9/1988 | Tsukahara et al. | 430/138 |
| 4,775,613 | 10/1988 | Hirai et al. | 430/505 |
| 4,782,010 | 11/1988 | Mader et al. | 430/538 |
| 4,792,514 | 12/1988 | Nakamura et al. | 430/138 |
| 4,798,780 | 1/1989 | Hall et al. | 430/264 |
| 4,798,790 | 1/1989 | Thomson et al. | 435/7 |
| 4,883,747 | 11/1989 | Grieve et al. | 430/542 |
| 4,889,932 | 12/1989 | Miller | 544/348 |
| 4,902,599 | 2/1990 | Yamamoto et al. | 430/138 |
| 4,923,792 | 5/1990 | Grieve et al. | 430/559 |
| 4,925,832 | 5/1990 | Hall et al. | 564/149 |
| 4,981,775 | 1/1991 | Swain et al. | 430/203 |
| 5,023,229 | 6/1991 | Evans et al. | 503/227 |
| 5,064,742 | 11/1991 | Aono et al. | 430/203 |
| 5,139,919 | 8/1992 | Taguchi et al. | 430/203 |
| 5,156,939 | 10/1992 | Koide | 430/203 |
| 5,262,272 | 11/1993 | Eian et al. | 430/203 |
| 5,266,452 | 11/1993 | Kitchin et al. | 430/510 |
| 5,330,864 | 7/1994 | Biavasco et al. | 430/619 |

OTHER PUBLICATIONS

J. W. Carpenter et al., "Photothermographic silver halide systems", *Research Disclosure,* No. 17029, pp. 9–15, Jun. 1978.

Hansjürgen Gölz et al., "N–Acy–N'–arylsulfonyldiazenes; Detection and Use in the Synthesis of Amides," *Angew. Chem. Int. Ed. Engl.,* 16, 728–729 (1977).

J. P. Kitchin et al., "An Improved Process of Hydrazine–Promoted Infectious Development of Silver Halide", *J. Photographic Sci.,* 35, 162–164 (1987).

D. H. Klosterboer, "Thermally Processed Silver Systems" in *Imaging Processes and Materials,* Neblettes Eighth Edition; J. Sturge et al. (Eds.); Van Nostrand Reinhold: New York; Chapter 9, 279–291 (1989).

G. Koga et al., "Radical Reactions of azo, hydrazo and azoxy compounds" in *The Chemistry of the Hydrazo, Azo and Azoxy Groups, Part 2:* John Wiley & Sons: New York; pp. 860–934 (Chapter 19) (1975).

P. W. Lauf, "Photothermographic Silver Halide Systems", *Research Disclosure,* No. 29963, pp. 208–214, Mar. 1989.

G. J. Lestina et al., "Hydrazide dye–releasing compounds", *Research Disclosure,* No. 12832, pp. 22–25, Dec. 1974.

"Methine and Polymethine Colouring Matters" in *The Colour Index;* The Society of Dyes and Colourists: Yorkshire, England; 4, 4437 (1971).

"Photothermographic silver halide material and process", *Research Disclosure,* No. 22812, pp. 155–156, Apr. 1983.
J. Sokolowska–Gajda et al., "The Synthesis of Disperse and Cationic Dyes from Acid Dye Structures," *Dyes and Pigments,* 14, 35–48 (1990).
H. Ulrich et al., "New Methods of Preparative Organic Chemistry VI", *Agnew. Chem., Int. Ed.,* 5, 704–712 (1966).
C. C. Van de Sande, "Dye Diffusion Systems in Color Photography," *Angew. Chem. Intl. Ed. Engl.,* 22, 191–209 (1983).
Von Heinrich Wieland et al., "Über das Aufteten freier Radikale bei chemischen Reaktionen. III," *Liebigs Ann. Chem.,* 446, 31–48 (1926).
D. E. Zabel et al., "Thermal Decomposition of Methyl and Phenyl Triphenylmethylazocarboxylates," *J. Org. Chem.,* 37, 2413–2418 (1972).

HYDRAZIDE REDOX-DYE-RELEASING COMPOUNDS FOR PHOTOTHERMOGRAPHIC ELEMENTS

BACKGROUND OF THE INVENTION

1. Field of the Invention

This invention relates to photothermographic materials that form color images upon light exposure and heat development. More specifically, this invention relates to hydrazide redox-dye-releasing ("RDR") compounds that are suitable for use in photothermographic imaging systems.

2. Background Art

Silver halide-containing, photothermographic imaging materials (i.e., heat-developable photographic elements) processed with heat, and without liquid development, have been known in the art for many years. These materials, also known as "dry silver" compositions or emulsions, generally comprise a support (also sometimes referred to as a substrate or film base) having coated thereon: (a) a photosensitive material that generates elemental silver when irradiated; (b) a non-photosensitive, reducible silver source; (c) a reducing agent for the non-photosensitive, reducible silver source; and (d) a binder. Thus, photothermographic systems are distinct from conventional wet silver photographic systems due to the presence of the non-photosensitive, reducible silver source and the reducing agent for this silver source.

The photosensitive material is generally photographic silver halide that must be in catalytic proximity to the non-photosensitive, reducible silver source. Catalytic proximity requires an intimate physical association of these two materials so that when silver atoms (also known as silver specks, clusters, or nuclei) are generated by irradiation or light exposure of the photographic silver halide, those nuclei are able to catalyze the reduction of the reducible silver source. It has long been understood that silver atoms (Ag°) are a catalyst for the reduction of silver ions, and that the photosensitive silver halide can be placed into catalytic proximity with the non-photosensitive, reducible silver source in a number of different fashions. For example, catalytic proximity can be accomplished by partial metathesis of the reducible silver source with a halogen-containing source (see, for example, U.S. Pat. No. 3,457,075); by coprecipitation of silver halide and the reducible silver source material (see, for example, U.S. Pat. No. 3,839,049); and by other methods that intimately associate the photosensitive photographic silver halide and the non-photosensitive, reducible silver source.

The non-photosensitive, reducible silver source is a material that contains silver ions. Typically, the preferred non-photosensitive, reducible silver source is a silver salt of a long chain aliphatic carboxylic acid having from 10 to 30 carbon atoms. The silver salt of behenic acid or mixtures of acids of similar molecular weight are generally used. Salts of other organic acids or other organic materials, such as silver imidazolates, have also been proposed. U.S. Pat. No. 4,260,677 discloses the use of complexes of inorganic or organic silver salts as non-photosensitive, reducible silver sources.

In photothermographic emulsions, exposure of the photosensitive material, e.g., photographic silver halide, to light produces small clusters of silver atoms (Ag°). The image-wise distribution of these clusters is known in the art as a latent image. This latent image is generally not visible by ordinary means. Thus, the photosensitive emulsion must be further processed in order to produce a visible image. The visible image is produced by the reduction of silver ions, which are in the non-photosensitive, reducible silver source and in catalytic proximity to silver halide grains bearing the clusters of silver atoms, i.e., the latent image.

The reducing agent for the non-photosensitive, reducible silver source, is often referred to as a "developer." It can be any material, preferably any organic material, that can reduce silver ions to metallic silver. At elevated temperatures, in the presence of the latent image, the non-photosensitive, reducible silver source (e.g., silver behenate) is reduced by this reducing agent to form a negative black-and-white image of elemental silver.

While conventional photographic developers such as methyl gallate, hydroquinone, substituted-hydroquinones, hindered phenols, catechol, pyrogallol, ascorbic acid, and ascorbic acid derivatives are useful, they tend to result in very reactive photothermographic formulations and fog during preparation and coating of the photothermographic element. As a result, hindered bisphenol reducing agents have traditionally been preferred although a wide range of reducing agents have been disclosed in dry silver systems. These include amidoximes, such as phenylamidoxime, 2-thienylamidoxime and p-phenoxy-phenylamidoxime; azines, such as 4-hydroxy-3,5-dimethoxybenzaldehydeazine; a combination of aliphatic carboxylic acid aryl hydrazides and ascorbic acid, such as 2,2'-bis(hydroxymethyl)propionyl-β -phenylhydrazide in combination with ascorbic acid; a combination of polyhydroxybenzene and hydroxylamine; a reductone and/or a hydrazine, such as a combination of hydroquinone and bis(ethoxyethyl)hydroxylamine, piperidinohexose reductone, or formyl-4-methylphenylhydrazine; hydroxamic acids, such as phenylhydroxamic acid, p-hydroxyphenylhydroxamic acid, and o-alaninehydroxamic acid; a combination of azines and sulfonamidophenols, such as phenothiazine with p-benzenesulfonamidophenol or 2,6-dichloro-4-benzenesulfonamidophenol; α-cyanophenylacetic acid derivatives, such as ethyl α-cyano-2-methylphenylacetate, ethyl α-cyano-phenylacetate; bis-o-naphthols, such as by 2,2'-dihydroxyl- 1-binaphthyl, 6,6'-dibromo-2,2'-dihydroxy-1,1'-binaphthyl, and bis(2-hydroxy- 1-naphthyl-)methane; a combination of bis-o-naphthol and a 1,3-dihydroxybenzene derivative, such as 2,4-dihydroxybenzophenone or 2,4-dihydroxyacetophenone; 5-pyrazolones such as 3-methyl-1-phenyl-5-pyrazolone; reductones, such as dimethylaminohexose reductone, anhydrodihydroaminohexose reductone, and anhydrodihydro-piperidone-hexose reductone; sulfonamidophemol reducing agents, such as 2,6-dichloro-4-benzenesulfonamidophenol and p-benzenesulfonamidophenol; indane-1,3-diones, such as 2-phenylindane-1,3-dione; chromans, such as 2,2-dimethyl-7-t-butyl-6-hydroxychroman; 1,4-dihydropyridines, such as 2,6-dimethoxy-3,5-dicarbethoxy-1,4-dihydropyridine; bisphenols, such as bis(2-hydroxy-3-t-butyl-5-methylphenyl)methane, 1,1-bis(2-hydroxy-3,5-dimethylphenyl)-3,5,5-trimethylhexane, 2,2-bis(4-hydroxy-3-methylphenyl-)propane, 4,4-ethylidene-bis(2-t-butyl-6-methylphenol), and 2,2-bis(3,5-dimethyl-4-hydroxyphenyl)propane; ascorbic acid derivatives, such as 1-ascorbylpalmitate, ascorbylstearate; unsaturated aldehydes and ketones; certain 1,3-indanediones; and 3-pyrazolidinones such as 1-phenyl-3-pyrazolidinone (phenidone) as described in *Research Disclosure,* June 1978, item 17029, and biphenyls such as 2,2'-dihydroxy- 3,3'-di-t-butyl-5,5'-dimethylbiphenyl as described in European Laid Open Patent Application No 0 509 740 A1.

As the visible image in black-and-white photothermographic elements is produced entirely by silver atoms (Ag°), one cannot readily decrease the amount of silver in the emulsion without reducing the maximum image density. However, reduction of the amount of silver is often desirable to reduce the cost of raw materials used in the emulsion and/or to enhance performance. For example, toning agents can be incorporated to improve the color of the silver image of the photothermographic element. Another method of increasing the maximum image density in photographic and photothermographic emulsions without increasing the amount of silver in the emulsion layer is by incorporating dye-forming materials in the emulsion. Upon imaging, the leuco dye is oxidized, and a dye and a reduced silver image are simultaneously formed in the exposed region. In this way, a dye-enhanced silver image can be produced.

A number of methods have been proposed for obtaining color images with dry silver systems. Such methods include, for example, incorporating dye-forming coupler materials into the dry silver systems. Known color-forming dry silver systems include: a combination of silver benzotriazole, a magenta, yellow, or cyan dye-forming coupler, an aminophenol developing agent, a base release agent such as guanidinium trichloroacetate, and silver bromide in polyvinyl butyral; and a combination of silver bromoiodide, sulfonamidophenol reducing agent, silver behenate, polyvinyl butyral, an amine such as n-octadecylamine, and 2-equivalent or 4-equivalent yellow, magenta or cyan dye-forming couplers.

Color images can also be formed by incorporation of dye forming or dye releasing compounds into the emulsion. Upon imaging, the dye forming or dye releasing material is oxidized and a dye and a reduced silver image are simultaneously formed in the exposed region.

U.S. Pat. No. 4,021,240 discloses the use of sulfonamidophenol reducing agents and four equivalent photographic color couplers in photothermographic emulsions to produce dye images. U.S. Pat. No. 3,531,286 discloses the use of photographic phenolic or active methylene color couplers in photothermographic emulsions containing p-phenylenediamine developing agents to produce dye images. U.S. Pat. No. 4,463,079 discloses the use of sulfonamidophenol and sulfonamidonaphthol redox-dye-releasing compounds which release a diffusible dye on heat development. U.S. Pat. No. 4,474,867 discloses the use of dye-releasing couplers which, in combination with a reducing agent, release a diffusible dye on heat development. U.S. Pat. No. 4,981,775 discloses the use of redox-dye-releasing compounds, e.g., oxazines, thiazines, and azines, that release a diffusible dye on heat development.

Color images can also be formed by incorporation of leuco dyes into the emulsion. A leuco dye is the reduced form of a color-bearing dye. It is generally colorless or very lightly colored. Upon imaging, the leuco dye is oxidized, and a color-bearing dye and a reduced silver image are simultaneously formed in the exposed region. In this way, a dye-enhanced silver image can be produced. U.S. Pat. No. 4,022,617 discloses the use of leuco dyes in photothermographic emulsions. The leuco dyes are oxidized to form a color image during the heat development of the photothermographic element. Chromogenic leuco dyes having various protecting groups are described in U.S. Pat. No. 5,330,864 and in Applicant's Assignees copending application Ser. No. 08/161,900 (filed Dec. 3, 1993).

Multicolor photothermographic imaging elements typically comprise two or more monocolor-forming emulsion layers (often each emulsion layer comprises a set of bilayers containing the color-forming reactants) maintained distinct from each other by barrier layers. The barrier layer overlaying one photosensitive, photothermographic emulsion layer typically is insoluble in the solvent of the next photosensitive, photothermographic emulsion layer. Photothermographic elements having at least two or three distinct color-forming emulsion layers are disclosed in U.S. Pat. Nos. 4,021,240 and 4,460,681. Various methods to produce dye images and multicolor images with leuco dyes are well known in the art as represented by U.S. Pat. Nos. 4,022,617; 3,531,286; 3,180,731; 3,761,270; 4,460,681; 4,883,747; and *Research Disclosure*, March 1989, item 29963. Various other dye-releasing systems have been disclosed in U.S. Pat. Nos. 4,060,420; 4,731,321; 4,088,496; 4,511,650; and 4,499,180.

The imaging arts have long recognized the field of photothermography as being clearly distinct from that of photography. Photothermographic elements significantly differ from conventional silver halide photographic elements which require wet-processing.

In photothermographic imaging elements, a visible image is created by heat as a result of the reaction of a developer incorporated within the element. Heat is essential for development. Temperatures of over 100° C. are routinely required. In contrast, conventional wet-processed photographic imaging elements require processing in aqueous processing baths to provide a visible image (e.g., developing and fixing baths). Development is usually performed at a more moderate temperature (e.g., 30°–50° C.).

In photothermographic elements only a small amount of silver halide is used to capture light. A different form of silver (i.e., the non-photosensitive, reducible silver source, such as silver behenate) is used to generate the image with heat. Thus, the silver halide serves as a catalyst for the development of the non-photosensitive, reducible silver source. In contrast, conventional wet-processed photographic elements use only one form of silver (e.g., silver halide) which, upon development, is converted to silver. Additionally, photothermographic elements require an amount of silver halide per unit area that is as little as one-hundredth of that used in a conventional wet-processed silver halide.

Photothermographic systems employ a light-insensitive silver salt, such as silver behenate, which participates with the developer in developing the latent image. In contrast, photographic systems do not employ a light-insensitive silver salt in the image-forming process. As a result, the image in photothermographic elements is produced primarily by reduction of the light-insensitive silver source (silver behenate) while the image in photographic black-and-white elements is produced primarily by the silver halide. In photothermographic elements, the unexposed silver halide inherently remains after development. Thus, the element must be stabilized against further development. In contrast, the silver halide is removed from photographic elements after development to prevent further imaging (i.e., the fixing step).

In photothermographic elements a number of binders are useful, whereas photographic elements are limited almost exclusively to hydrophilic colloidal binders such as gelatin. Furthermore, in photothermographic elements, all of the "chemistry" of the system is incorporated within the element itself. For example, photothermographic elements incorporate a developer (i.e., a reducing agent for the non-photosensitive, reducible source of silver) within the element while conventional photographic elements do not. Even in instant photography, developer chemistry is physically separated from the silver halide until development is desired. The incorporation of the developer into photothermographic elements can lead to increased formation of "fog" upon coating of photothermographic emulsions as compared to photographic emulsions.

Because photothermographic elements require thermal processing, they pose different considerations and present distinctly different problems in manufacture and use. In addition, the effects of additives (e.g., stabilizers, antifoggants, speed enhancers, sensitizers, supersensitizers, etc.), which are intended to have a direct effect upon the imaging process, can vary depending upon whether they have been incorporated in a photothermographic element or incorporated in a photographic element.

Other distinctions between photothermographic and photographic elements are described in *Imaging Processes and Materials* (*Neblette's Eighth Edition*); J. Sturge et al. Ed; Van Nostrand Reinhold: New York, 1989; Chapter 9 and in *Unconventional Imaging Processes;* E. Brinckman et al, Ed; The Focal Press: London and New York: 1978; pp. 74–75.

Hydrazides have been used in conventional wet processed black-and-white and color photographic systems. They have found use as nucleating agents, infectious developers, contrast and speed improving agents, and color developing agents. U.S. Pat. No. 4,902,599 describes the combination of hydrazine and a hydrazide, and color image formation by a coupler-developer reaction.

Sulfonyl hydrazides have been used in traditional dye diffusion transfer instant photography. The decomposition of sulfonyl-hydrazides has been studied by H. Golz, et al., *Angew. Chem. Int. Ed. Engl.,* 16(10), 728–729 (1977). Low temperature oxidation with lead tetraacetate leads to the azo compound which can then undergo further decomposition by loss of nitrogen.

G. J. Lestina, et al., *Research Disclosure,* December 1974, item 12832 describes the use of hydrazide dye-releasing compounds in color photography. Dye is released upon alkaline hydrolysis of the acylazo- or sulfonylazo compound generated upon exposure in the presence of AgX, a silver halide developer, and an electron transfer agent. U.S. Pat. No. 3,844,785 describes sulfonyl hydrazides as dye forming compounds in a dye diffusion transfer photographic process. U.S. Pat. No. 4,386,150 uses dyes attached to hydrazides including sulfonyl hydrazides in a construction for instant photography. This construction requires aqueous alkaline processing.

Japanese Laid Open Patent Publication No. JP 63-113455 describes the use of sulfonyl hydrazides attached to a pre-formed dye moiety in thermally developed photographic elements containing large amounts of photosensitive silver halide relative to non-photosensitive silver salts. Development of these materials takes place in a basic aqueous environment, however.

It is an object of the present invention to provide alternative heat developable color photographic materials capable of releasing dyes to provide clear, stable color images.

SUMMARY OF THE INVENTION

The present invention provides hydrazide redox-dye-releasing ("RDR") compounds, and photothermographic elements containing these RDR compounds. The photothermographic elements of the present invention include a support bearing at least one heat-developable, photosensitive, image-forming photothermographic emulsion layer comprising:

(a) a photosensitive silver halide;

(b) a non-photosensitive, reducible source of silver;

(c) a reducing agent for the non-photosensitive, reducible silver source; and (d) a binder;

wherein the reducing agent (i.e., developer) comprises a hydrazide redox-dye-releasing compound. The hydrazide redox-dye-releasing compound comprises a sulfonyl hydrazide group linked to the chromophore of a thermally mobile dye. Specifically, the hydrazide redox-dye-releasing compound is of the following general formulae:

$$R^1—[—C(O)—NH—NH—SO_2—X—D]_n \text{ or } [D—X—C(O)—NH—NH—SO_2—]_n—R^2$$

wherein: D represents the chromophore of a thermally mobile dye; X represents a single bond or a divalent linking group; $n \geqq 1$; and $R^1$ and $R^2$ independently represent an organic group.

The elements of the invention are capable of producing a silver image having a negative-positive relationship to the original and a thermally mobile dye in the area corresponding to the silver image. After imagewise exposure to light, heating produces an oxidation-reduction reaction between the reducible source of silver and the dye-releasing compound, which is catalyzed by exposed, photosensitive silver halide, to form a silver image in the exposed areas. In this reaction, the redox-dye-releasing compound is oxidized with the release of a thermally mobile dye. Accordingly, the silver image and the thermally mobile dye are both present in the exposed area. A color image is obtained by transferring the thermally mobile dye to a dye-receiving layer, which may be present in the element or may be a separate dye-receiving sheet that is placed in contact with the element during heat development.

When the photothermographic element used in this invention containing a reducing agent for the non-photosensitive reducible silver source is heat developed, preferably at a temperature of from about 80° C. to about 250° C. (176° F. to 482° F.) for a duration of from about 1 second to about 2 minutes, in a substantially water-free condition after, or simultaneously with, imagewise exposure, a black-and-white silver image either in exposed areas or in unexposed areas with exposed photosensitive silver halide is obtained.

The term "substantially water-free condition" means that the reaction system is in approximate equilibrium with water in the air, and water for inducing or promoting the reaction is not added to the element. Such a condition is described in T. H. James The Theory of the Photographic Process, Fourth Edition, page 374.

As used herein, the term "emulsion layer" means a layer of a photothermographic element that contains a photosensitive silver salt and a non-photosensitive, reducible silver source. The term "chromophore" refers to the light-absorbing portion of a dye molecule. The term "redox-dye-releasing compound" refers to a compound that releases a thermally mobile dye as a result of a redox reaction. The term "change in color" includes an increase in optical density of at least 0.2 units between the unexposed and the exposed regions.

Other aspects, advantages, and benefits of the present invention are apparent from the detailed description, the examples, and the claims.

DETAILED DESCRIPTION OF THE INVENTION

As stated above, silver halide-containing photothermographic imaging materials, i.e., "dry silver" compositions or emulsions, of the present invention include a support having coated thereon:

(a) a photosensitive material that generates elemental silver when irradiated, e.g., a photosensitive silver halide;

(b) a non-photosensitive, reducible source of silver;

(c) a reducing agent for the non-photosensitive, reducible silver source; and (d) a binder.

Specifically, the present invention is directed to such compositions containing a hydrazide dye, i.e., a hydrazide redox-dye-releasing compound, as the reducing agent. These compositions are used in the essentially water-free conditions typically used in thermally developed photographic systems, i.e., photothermographic systems. Furthermore, they do not include highly alkaline components.

The Dye-Releasing Material

The reducing agent for the reducible source of silver used in the present invention is a hydrazide redox-dye-releasing compound that can be oxidized and thereby release a colored thermally mobile dye to produce a visible image. The hydrazide redox-dye-releasing compound is of the following general formulae:

$$R^1—[—C(O)—NH—NH—SO_2—X—D]_n \text{ or } [D—X—C(O)—NH—NH—SO_2]_n—R^2$$

wherein: D represents the chromophore of a thermally mobile dye; X represents a single bond or a divalent linking group that binds the chromophore of the thermally mobile dye to a sulfonyl hydrazide either through the carbonyl moiety or through the sulfonyl moiety; $R^1$ and $R^2$ independently represent an organic group, which can be multivalent, including ballasting groups; and $n \geqq 1$, preferably n= 1–50, and more preferably n= 1–4, and most preferably n= 1. Preferably, the hydrazide redox-dye-releasing compounds of the present invention are represented by the formula $R^1—[—C(O)—NH—NH—SO_2—X—D]_n$ and more preferably $R^1—C(O)—NH—NH—SO_2—X—D$.

The linking group X is one that does not confer unwanted color changes to the thermally mobile dye. Although the linking group X is preferably a single bond, it can be a divalent group of the formula $—R^3—L—$ wherein $R^3$ is a divalent hydrocarbon chain capable of bonding to the carbonyl or sulfonyl group, preferably containing up to 12 carbon atoms, and L is any group that can bond to both $R^3$ and D. Examples of suitable $R^3$ groups include alkylene groups such as methylene, ethylene, propylene, butylene, etc., arylene groups such as phenylene, naphthalene, as well as groups containing both aliphatic and aromatic groups in the main chain such as $—CH_2—CH_2—C_6H_4—CH_2—CH_2—$. Examples of suitable L groups include a single bond, —NH—, $—NHSO_2—$, —C(O)—, —C(O)—O—, —NH—C(O)—O—, —NH—C(S)—, —NH—C(O)—NH—, etc.

$R^1$ and $R^2$ each represent an organic group, which can be mono- or multivalent, preferably containing 1–30 carbon atoms, and more preferably containing 1–20 carbon atoms. These groups can include aliphatic groups, aromatic groups or mixtures thereof (i.e., alkaryl and aralkyl groups) having nonperoxidic O, N, S, atoms as well as carbonyl moieties in the chain. In the context of the present invention, the term "aliphatic group" means a saturated or unsaturated linear, branched, or cyclic hydrocarbon group. This term is used to encompass cyclic as well as alicyclic groups, optionally including heteroatoms such as nitrogen, oxygen, and sulfur. It is also used to encompass alkyl, alkoxy, alkenyl and vinyl groups, for example. The term "alkyl group" means a saturated linear, branched, or cyclic hydrocarbon group including, for example, methyl, ethyl, t-butyl, isopropyl, heptyl, dodecyl, octadecyl, amyl, 2-ethylhexyl, and the like. The term "alkoxy group" means an alkyl group attached to a molecule by oxygen. The terms "aromatic group" or "aryl group" means a mono- or polynuclear aromatic hydrocarbon group, optionally including heteroatoms such as nitrogen, oxygen, and sulfur.

As is well understood in this technical area, a large degree of substitution is not only tolerated, but is often advisable. Substitution is anticipated on the compounds used in the present invention. As a means of simplifying the discussion and recitation of certain terminology used throughout this application, the terms "group" and "moiety" are used to differentiate between chemical species that allow for substitution or which may be substituted and those which do not so allow or may not be so substituted. Thus, when the term "group" is used to describe a chemical substituent, the described chemical material includes the unsubstituted group and that group with conventional substitution. Where the term "moiety" is used to describe a chemical compound or substituent, only an unsubstituted chemical material is intended to be included. For example, the phrase "alkyl group" is intended to include not only pure open-chain and cyclic saturated hydrocarbon alkyl substituents, such as methyl, ethyl, propyl, t-butyl, cyclohexyl, adamantyl, octadecyl, and the like, but also alkyl substituents bearing further substituents known in the art, such as hydroxy, alkoxy, aryloxy, arylsulfonyl, alkylsulfonyl, vinyl, phenyl, halogen atoms (F, Cl, Br, and I), cyano, carbamoyl, nitro, amino, carboxyl, etc. Thus, "alkyl group" includes ether groups (e.g., $CH_3—CH_2—CH_2—O—CH_2—$), haloalkyls, nitroalkyls, carboxyalkyls, hydroxyalkyls, sulfoalkyls, etc. On the other hand, the phrase "alkyl moiety" is limited to the inclusion of only pure open-chain and cyclic saturated hydrocarbon alkyl substituents, such as methyl, ethyl, propyl, t-butyl, cyclohexyl, adamantyl, octadecyl, and the like. Substituents that react with active ingredients, such as very strong electrophilic or oxidizing substituents, would of course be excluded by the ordinary skilled artisan as not being inert or harmless.

Preferably, $R^1$ and $R^2$ are each independently selected from the group consisting of alkyl and alkenyl groups of up to 20 carbon atoms, more preferably alkyl and alkenyl of up to 10 carbon atoms, most preferably alkyl and alkenyl groups of up to 5 carbon atoms; alkoxy groups of up to 20 carbon atoms, more preferably of up to 10 carbon atoms, and most preferably of up to 5 carbon atoms; aryl, alkaryl, and aralkyl groups of up to 20 carbon atoms, more preferably of up to 10 carbon atoms, and most preferably up to 6 carbon atoms; aryloxy groups of up to 20 carbon atoms, more preferably of up to 10 carbon atoms, and most preferably of up to 6 carbon atoms; non-aromatic and aromatic heterocyclic ring groups containing up to 6 ring atoms; alicyclic ring groups comprising up to 6 ring carbon atoms; and fused ring and bridging groups comprising up to 14 ring atoms. As noted above, $R^1$ and/or $R^2$ may contain additional substituent groups as described above.

In particularly preferred embodiments, when $n > 1$, $R^1$ and $R^2$ represent an n-valent organic group, typically comprising atoms selected from C, H, N, O, S, Si, and P. More specifically, in this situation $R^1$ and $R^2$ satisfy the formula $R^4—(—L^1—)—n$, where $R^4$ is an n-valent atom or group and $L^1$ is a single bond or divalent linking group. $L^1$ is preferably chosen from the same list of linking groups as described for X in the previous formulae. For values of n in the range of 2–6, $R^4$ is preferably an atom, a branched aliphatic chain or a ring. Suitable rings include cycloaliphatic rings (e.g., cyclohexyl), aromatic rings (e.g., phenyl) and siloxane rings. For n> 6, $R^4$ is preferably a polymer backbone, such as a polyurethane, polyester, polycarbonate or polyether backbone, or a backbone resulting from the polymerization or copolymerization of vinyl monomers such as styrene derivatives and acrylate and methacrylate esters.

Each $R^1$ and $R^2$ can be a "ballasting group" that reduces the thermal mobility of the hydrazide redox-dye-releasing compound in the binder. While the size and number of carbon atoms required for the ballasting group can vary, it is preferred that the ballasting group be of a sufficient molecular weight to render the hydrazide redox-dye-releasing compound substantially thermally immobile at a temperature of about 80°–250° C. The molecular weight of the ballasting group must not be so high, however, that the resulting amount of the released dye is insufficient to yield a dye image having a reflection optical density of at least 0.3 or a transmission optical density of at least 0.2. To meet these requirements, the ballasting group has a molecular weight of at least about 100 and no greater than about 20,000, preferably no greater than about 15,000, more preferably no greater than about 10,000, and most preferably no greater than about 2,000.

The ballasting group can be a monomer, oligomer, or polymer. A polymeric ballasting group is a particularly effective method of ballasting the redox-dye-releasing compounds of the present invention, thereby rendering the compounds substantially thermally immobile at a temperature of about 80°–250° C. and providing a high degree of differential mobility between the released thermally mobile dye and the remaining unreacted redox-dye-releasing compound. Representative polymeric ballasting groups are shown in RDR compounds XI and XIII.

Representative examples of ballasting groups include long chain aliphatic groups, e.g., having at least 8 carbon atoms, aromatic rings containing a long chain aliphatic group, e.g., having at least 8 carbon atoms, preferably an aromatic ring containing a long chain alkoxy group, e.g., having at least 8 carbon atoms. These groups can include one or more hydroxy moieties per molecule, thereby forming alcohol or glycol monomeric units. Representative examples of ballasted groups that can be used in the compounds of the present invention include $—O—C_8H_{16}$, $—O—C_{12}H_{25}$, $—O—C_{18}H_{37}$, $—O—C_{22}H_{45}$, and $—O—C(O)—NH—(NH—(CH_2)_{36}—NH—C(O)—OCH_3$.

Whether classified as a ballasting group or not, particularly preferred $R^1$ and $R^2$ groups are the following: $—(CH_2)_6CH_3$, $(CH_2)_{10}CH_3$, $—(CH_2)_{16}CH_3$, $—(CH_2)_2—C_6H_4—OH$, $—(CH_2)_{14}—OH$, $—(CH_2)_2—C_6H_4—OH$, $—CH_2—C_6H_4—O—(CH_2)_8—OH$, $—CH_2—C_6H_4—O—(CH_2)_9—CH_2OH$, $—CH_2(OH)—CH_2(OH)$, $—C_6H_5$, and $—C_6H_4—CH_3$.

A particularly effective form of ballasting is that disclosed in UK Patent Application No. 9404805.5, filed Mar. 11, 1994, in which two or more redox dye releasing compounds are linked together to form dimers, trimers, tetramers, etc., up to and including high molecular weight polymers. In this embodiment, n in the formulae listed above is 2 or more, preferably 3 or more, most preferably 4 or more. By linking a plurality of redox-dye-releasing species together, bulky molecules with very low thermal mobility are produced, yet the chemical reactivity remains high, and the efficiency (expressed in equivalents of dye released per unit weight of redox-dye-releaser) is much greater than for "monomeric" species of equivalent ballasting power.

A thermally mobile dye is a dye that is capable of moving under the influence of heat, by diffusion through a polymeric binder and/or by sublimation across an air gap from its point of release to a receiving layer. Preferably, the dye should become mobile at a temperature of about 80°–250° C., and more preferably at a temperature of about 120°–200° C.

Suitable thermally mobile dyes for use in the compounds of the present invention, i.e., the dyes released by the redox-dye-releasing compounds of the present invention, have excellent thermal mobility in the polymeric binder and through any polymeric barrier layers, good hue, a large molar extinction coefficient, and good fastness to heat and light. Such dyes are known and disclosed, for example, in *The Colour Index;* The Society of Dyes and Colourists: Yorkshire, England; 1971; Vol. 4; p. 4437. Examples include azo dyes, azomethine dyes, azamethine dyes, anthraquinone dyes, naphthoquinone dyes, styryl dyes, nitro dyes, benzylidene dyes, oxazine dyes, diazine dyes, thiazine dyes, ketazine dyes, imidazole dyes, merocyanine dyes, benzodifuranone dyes, quinoline dyes, triphenylmethane dyes, as well as chromogenic dyes such as indophenol dyes and indoaniline dyes. Specific examples of useful thermally mobile dyes are the dyes listed in U.S. Pat. No. 4,336,322 (the cyan dye or dye precursor portions "COL" of compounds C-1 through C-22, the magenta dye or dye precursor portions of compounds $M_1$-1 through $M_1$-26, M-1 through M-4, $M_2$-1 through $M_2$-60, and the yellow dye or dye precursor portions of compounds Y-1 through Y-33 and 1–2); U.S. Pat. No. 4,055,428; U.S. Pat. No. 4,473,631 (the yellow and magenta dyes listed in columns 17–24); U.S. Pat. No. 4,474,857 (the yellow, magenta, and cyan dyes listed in columns 12–20); GB Patent Document No. 2,100,016A (the yellow, magenta, and cyan dyes listed at pages 12–19); and U.S. Pat. No. 4,981,775 (the chromophores D excluding linking group A, listed in columns 4–6).

The chromophore of the thermally mobile dye can be incorporated into the hydrazide dye reducing agent, for example, using a dye with a reactive functional group such as $—SO_2Cl$, $—C(O)Cl$, $—N=C=O$, $—N=C=S$, $—SO_2—N=C=O$, and the like. Generally speaking, the redox dye releasing compounds are prepared by reacting species such as $D—X—C(O)Cl$, $D—X—SO_2Cl$ or $D—X—NCO$ with $R—O—C(O)—NHNH_2$ or $R—SO_2—NHNH_2$ (where D, X, and R have the same meanings as above wherein R represents either $R^1$ or $R^2$). If the linking together of two or more redox-dye-releasing moieties is desired, the group R should be chosen so that it is capable of undergoing linking (polymerising) reactions with itself and/or co-monomers. Alternatively, multifunctional hydrazines $R—[(CO)—NHNH_2]_n$ or $R—[SO_2—NHNH_2]_n$ may be reacted with $D—X—C(O)Cl$, etc.

Representative hydrazide redox-dye-releasing compounds of the present invention are shown below. These representations are exemplary and are not intended to be limiting. They can be synthesized as shown later herein.

RDR Compound I
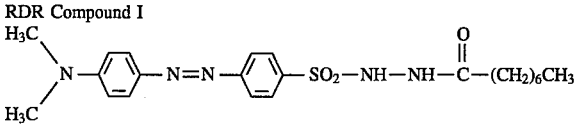
RDR Compound II
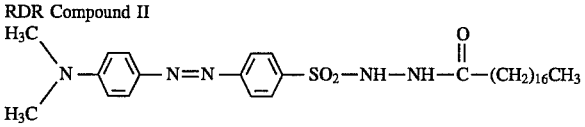
RDR Compound III
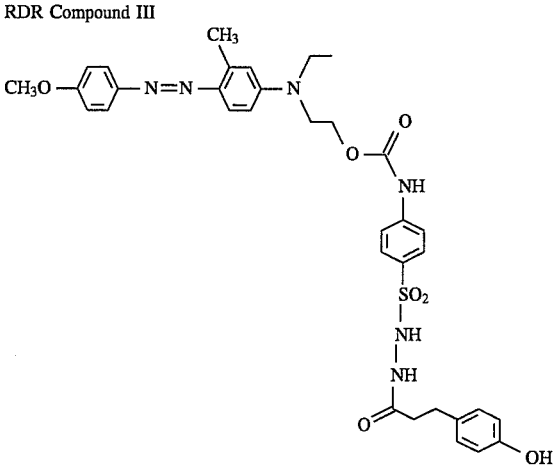
RDR Compound IV
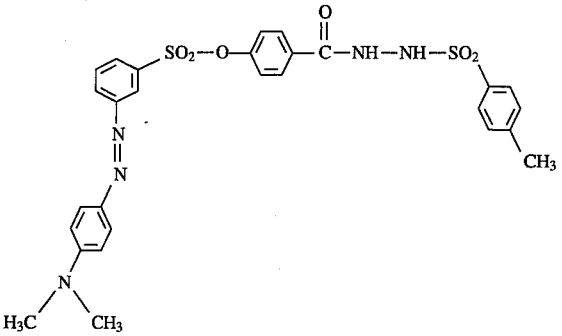
RDR Compound V
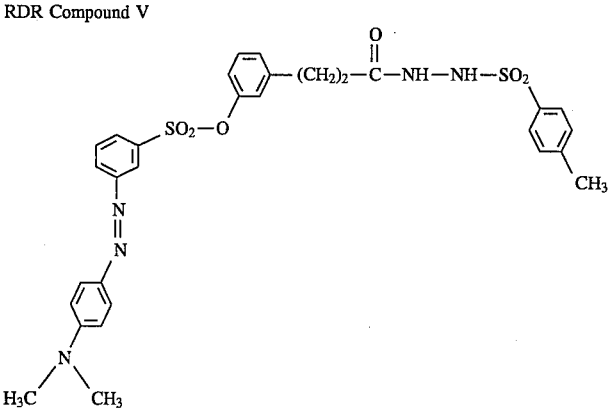
RDR Compound VI
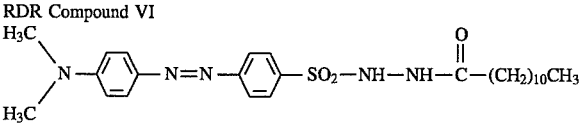
RDR Compound VII -continued
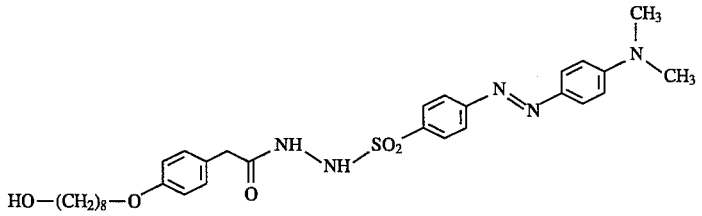
RDR Compound VIII
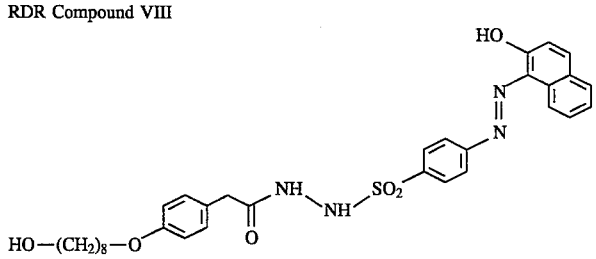
RDR Compound IX
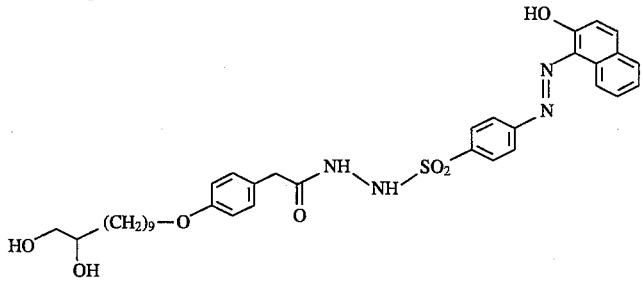
RDR Compound X
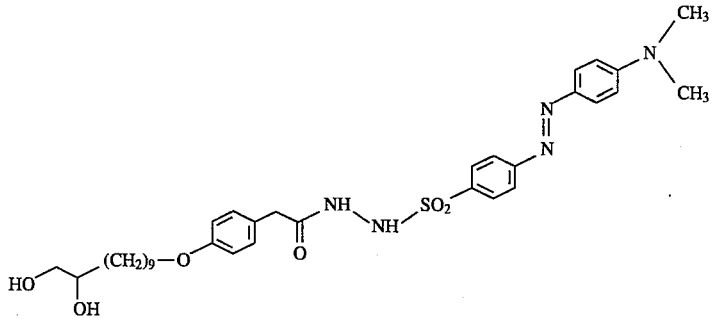
RDR Compound XI
Copolymer of
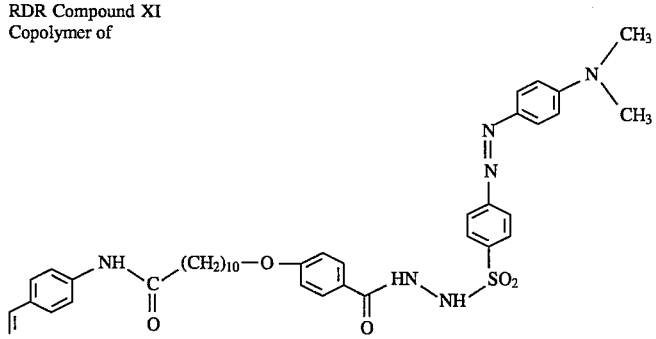
and $H_2C{=}C(CH_3){-}C(=O){-}O{-}(CH_2)_3{-}CH_3$
RDR Compound XII -continued

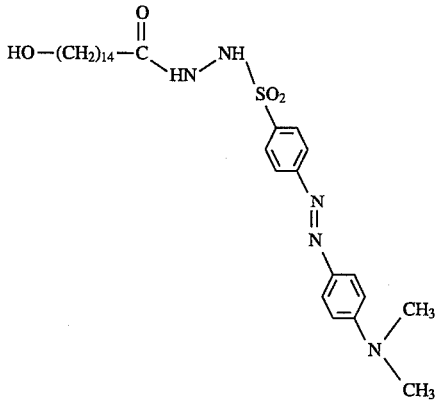

RDR Compound XIII

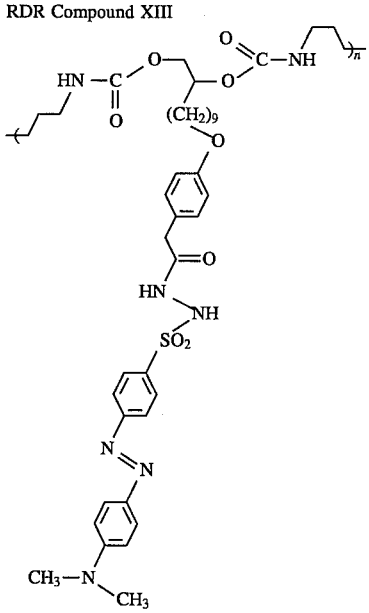

The absorption maxima of the dyes released from the hydrazide redox-dye-releasing compounds of the present invention in the various color-forming layers should, of course, be different. A difference of at least about 60 nm in reflective maximum absorbance is preferred. More preferably, the absorbance maximum of dyes released will differ by at least about 80–100 nm. When three dyes are to be released, two should preferably differ by at least these minimums, and the third should preferably differ from at least one of the other dyes by at least about 150 nm, and more preferably, by at least about 200 nm. As previously noted, any hydrazide dye that is capable of being oxidized by silver ion to release a dye is useful in the present invention.

The total amount of hydrazide redox-dye-releasing compound used as a reducing agent utilized in the present invention should preferably be about 0.5–50 weight percent, and more preferably, about 1–25 weight percent, based upon the total weight of each individual layer in which the reducing agent is employed.

The Photosensitive Silver Halide

As noted above, the present invention includes a photosensitive silver halide in the photothermographic construction. The photosensitive silver halide can be any photosensitive silver halide, such as silver bromide, silver iodide, silver chloride, silver bromoiodide, silver chloro-bromoiodide, silver chlorobromide, etc. The photosensitive silver halide can be added to the emulsion layer in any fashion so long as it is placed in catalytic proximity to the organic silver compound which serves as a source of reducible silver.

The silver halide used in the present invention may be employed without modification. However, it can be chemically and spectrally sensitized in a manner similar to that used to sensitize conventional wet process silver halide or state-of-the-art heat-developable photographic materials. For example, it may be chemically sensitized with a chemical sensitizing agent, such as a compound containing sulfur, selenium, tellurium, etc., or a compound containing gold, platinum, palladium, ruthenium, rhodium, iridium, etc., a reducing agent such as a tin halide, etc., or a combination thereof. The details of these procedures are described in T. H. James, *The Theory of the Photographic Process,* Fourth Edition, Chapter 5, pages 149 to 169. Suitable chemical sensitization procedures are also described in U.S. Pat. Nos. 1,623,499; 2,399,083; 3,297,447; and 3,297,446.

The photosensitive silver halides may be spectrally sensitized with various known dyes that spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes, and complex merocyanine dyes are particularly useful.

The silver halide may be "pre-formed" and mixed with the organic silver salt in a binder prior to use to prepare a coating solution. Materials of this type are often referred to as "pre-formed emulsions." The silver halide may be preformed by any means, e.g., in accordance with U.S. Pat. No. 3,839,049. Methods of preparing these silver halide and organic silver salts and manners of blending them and methods of forming pre-formed emulsions are described in *Research Disclosure,* June, 1978, item 17029; U.S. Pat. Nos. 3,700,458 and 4,076,539; and Japanese patent application Nos. 13224/74, 17216/75, and 42529/76. For example, it is effective to blend the silver halide and organic silver salt using a homogenizer for a long period of time.

Pre-formed silver halide emulsions when used in the material of this invention can be unwashed or washed to remove soluble salts. In the latter case the soluble salts can be removed by chill-setting and leaching or the emulsion can be coagulation washed, e.g., by the procedures described in U.S. Pat. Nos. 2,618,556; 2,614,928; 2,565,418; 3,241,969; and 2,489,341. The silver halide grains may have any crystalline habit including, but not limited to, cubic, tetrahedral, orthorhombic, tabular, laminar, platelet, etc. The silver halide grains may have a uniform ratio of halide throughout; they may have a graded halide content, with a continuously varying ratio of, for example, silver bromide and silver iodide; or they may be of the core-shell-type, having a discrete core of one halide ratio, and a discrete shell of another halide ratio.

It is also effective to use an in situ process, i.e., a process in which a halogen-containing compound is added to an organic silver salt to partially convert the silver of the organic silver salt to silver halide.

The light sensitive silver halide used in the present invention can be employed in a range of about 0.005 mole to about 0.5 mole and, preferably, from about 0.01 mole to about 0.15 mole per mole of non-photosensitive reducible silver salt. An appropriate amount of sensitizing dye added is generally about $10^{-10}$ to $10^{-1}$ mole, and preferably about $10^{-8}$ to $10^{-3}$ moles per mole of silver halide.

The Non-Photosensitive Reducible Silver Source Material

The non-photosensitive reducible silver source that can be used in the present invention can be any material that contains a source of reducible silver ions. Preferably, it is a silver salt which is comparatively stable to light and forms a silver image when heated to 80° C. or higher in the presence of an exposed photocatalyst (such as silver halide) and a reducing agent. Salts of organic acids, such as the silver salt of behenic acid, or other salts of organic materials, such as silver imidazolates, have been proposed. U.S. Pat. No. 4,260,677 discloses the use of complexes of inorganic or organic silver salts as non-photosensitive, reducible silver sources. Complexes of organic or inorganic silver salts, wherein the ligand has a gross stability constant for silver ion of about 4.0–10.0, are also useful in this invention.

Silver salts of organic acids, particularly silver salts of long chain fatty carboxylic acids, are preferred. The chains typically contain 10 to 30, preferably 15 to 28, carbon atoms. Suitable organic silver salts include silver salts of organic compounds having a carboxyl group. Examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laurate, silver caproate, silver myristate, silver palmitate, silver maleate, silver fumarate, silver tartrate, silver furoate, silver linoleate, silver butyrate, silver camphorate, and mixtures thereof, etc. Silver salts that can be substituted with a halogen atom or a hydroxyl group also can be effectively used. Preferred examples of the silver salts of aromatic carboxylic acids and other carboxyl group-containing compounds include: silver benzoate, a silver-substituted benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc.; silver gallate; silver tannate; silver phthalate; silver terephthalate; silver salicylate; silver phenylacetate; silver pyromellitate; a silver salt of 3-carboxymethyl-4-methyl-4-thiazoline-2-thione or the like as described in U.S. Pat. No. 3,785,830; and a silver salt of an aliphatic carboxylic acid containing a thioether group as described in U.S. Pat. No. 3,330,663.

Silver salts of compounds containing mercapto or thione groups and derivatives thereof can also be used. Preferred examples of these compounds include: a silver salt of 3-mercapto-4-phenyl-1,2,4-triazole; a silver salt of 2-mercaptobenzimidazole; a silver salt of 2-mercapto-5-aminothiadiazole; a silver salt of 2-(2-ethylglycolamido)benzothiazole; a silver salt of thioglycolic acid, such as a silver salt of a S-alkylthioglycolic acid (wherein the alkyl group has from 12 to 22 carbon atoms); a silver salt of a dithiocarboxylic acid such as a silver salt of dithioacetic acid; a silver salt of thioamide; a silver salt of 5-carboxylic-1-methyl- 2-phenyl-4-thiopyridine; a silver salt of mercaptotriazine; a silver salt of 2-mercaptobenzoxazole; a silver salt as described in U.S. Pat. No. 4,123,274, for example, a silver salt of a 1,2,4-mercaptotriazole derivative, such as a silver salt of 3-amino- 5-benzylthio-1,2,4-triazole; and a silver salt of a thione compound, such as a silver salt of 3-(2-carboxyethyl)-4-methyl-4-thiazoline-2-thione.

Silver salts of acetylenes can also be used. Silver acetylides are described in U.S. Pat. Nos. 4,761,361 and 4,775,613.

Furthermore, a silver salt of a compound containing an imino group can be used. Preferred examples of these compounds include: silver salts of benzotriazole and substituted derivatives thereof, for example, silver methylbenzotriazole and silver 5-chlorobenzotriazole, etc.; silver salts of 1,2,4-triazoles or 1-H-tetrazoles as described in U.S. Pat. No. 4,220,709; and silver salts of imidazoles and imidazole derivatives.

It is also convenient to use silver half soaps. A preferred example of a silver half soap is an equimolar blend of silver behenate and behenic acid, which analyzes for about 14.5% silver and which is prepared by precipitation from an aqueous solution of the sodium salt of commercial behenic acid.

Transparent sheet materials made on transparent film backing require a transparent coating. For this purpose a silver behenate full soap, containing not more than about 15 percent of free behenic acid and analyzing for about 22 percent silver, can be used. The method used for making silver soap dispersions is well known in the art and is disclosed in *Research Disclosure,* April 1983, item 22812; *Research Disclosure,* October 1983, item 23419; and U.S. Pat. No. 3,985,565.

The silver halide and the non-photosensitive reducible silver source material that form a starting point of development should be in catalytic proximity, i.e., reactive association. By "catalytic proximity" or "reactive association" is meant that they should be in the same layer, in adjacent layers, or in layers separated from each other by an intermediate layer having a thickness of less than 1 micrometer (1 μm). It is preferred that the silver halide and the non-photosensitive reducible silver source material be present in the same layer.

Photothermographic emulsions containing pre-formed silver halide in accordance with this invention can be sensitized with chemical sensitizers, or with spectral sensitizers as described above.

The source of reducible silver material generally constitutes about 15 to about 70 percent by weight of the emulsion layer. It is preferably present at a level of about 30 to about 55 percent by weight of the emulsion layer.

The Binder

The photosensitive silver halide, the non-photosensitive reducible source of silver, the hydrazide redox-dye-releasing compound, and other addenda used in the present invention are generally added to at least one binder. It is preferred that the binder be selected from polymeric materials, such as, for example, natural and synthetic resins that are sufficiently polar to hold the other ingredients of the emulsion in solution or suspension.

A typical hydrophilic binder is a transparent or translucent hydrophilic colloid. Examples of hydrophilic binders include: a natural substance, for example, a protein such as gelatin, a gelatin derivative, a cellulose derivative, etc.; a polysaccharide such as starch, gum arabic, pullulan, dextrin, etc.; and a synthetic polymer, for example, a water-soluble polyvinyl compound such as polyvinyl alcohol, polyvinyl pyrrolidone, acrylamide polymer, etc. Another example of a hydrophilic binder is a dispersed vinyl latex compound which is used for the purpose of increasing dimensional stability of a photographic element.

Examples of typical hydrophobic binders are polyvinyl acetals, polyvinyl chloride, polyvinyl acetate, cellulose acetate, polyolefins, polyesters, polystyrene, polyacrylonitrile, polycarbonates, methacrylate copolymers, maleic anhydride ester copolymers, butadiene-styrene copolymers, and the like. Copolymers, e.g. terpolymers, are also included in the definition of polymers. The polyvinyl acetals, such as polyvinyl butyral and polyvinyl formal, and vinyl copolymers such as polyvinyl acetate and polyvinyl chloride are particularly preferred.

The binder(s) that can be used in the present invention can be employed individually or in combination with one another. Although the binder can be hydrophilic or hydrophobic, preferably it is hydrophobic.

The binders are preferably used at a level of about 20–80 percent by weight of the emulsion layer, and more preferably at a level of about 30–55 percent by weight. Where the proportions and activities of the redox-dye-releasing compounds of the present invention require a particular developing time and temperature, the binder should be able to withstand those conditions. Generally, it is preferred that the binder not decompose or lose its structural integrity at 250° F. (121° C.) for 30 seconds, and more preferred that it not decompose or lose its structural integrity at 350° F. (177° C.) for 60 seconds.

The polymer binder is used in an amount sufficient to carry the components dispersed therein, that is, within the effective range of the action as the binder. The effective range can be appropriately determined by one skilled in the art.

Photothermographic Formulations

The formulation for the photothermographic emulsion layer can be prepared by dissolving and dispersing the binder, the photosensitive silver halide, the non-photosensitive reducible source of silver, the hydrazide dye reducing agent for the non-photosensitive reducible silver source, and optional additives, in an inert organic solvent, such as, for example, toluene, 2-butanone, or tetrahydrofuran.

The use of "toners" or derivatives thereof which improve the image, is highly desirable, but is not essential to the element. Toners can be present in an amount of about 0.01–10 percent by weight of the emulsion layer, preferably about 0.1–10 percent by weight. Toners are well known materials in the photothermographic art, as shown in U.S. Pat. Nos. 3,080,254; 3,847,612; and 4,123,282.

Examples of toners include: phthalimide and N-hydroxyphthalimide; cyclic imides such as succinimide, pyrazoline-5-ones, quinazolinone, 1-phenylurazole, 3-phenyl-2-pyrazoline-5-one, and 2,4-thiazolidinedione; naphthalimides such as N-hydroxy-1,8-naphthalimide; cobalt complexes such as cobaltic hexamine trifluoroacetate; mercaptans such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides such as (N,N-dimethylaminomethyl)phthalimide, and N,N-(dimethylaminomethyl)naphthalene-2,3-dicarboximide; a combination of blocked pyrazoles, isothiuronium derivatives, and certain photobleach agents such as a combination of N,N'-hexamethylene-bis(1-carbamoyl-3,5-dimethylpyrazole), 1,8-(3,6-diaza-octane)bis(isothiuronium)trifluoroacetate, and 2-tribromomethylsulfonyl benzothiazole; merocyanine dyes such as 3-ethyl-5-[(3-ethyl-2-benzothiazolinylidene)- 1-methyl-ethylidene]-2-thio-2,4-o-azolidinedione; phthalazinone, phthalazinone derivatives, or metal salts of these derivatives, such as 4-(1-naphthyl)phthalazinone, 6-chlorophthalazinone, 5,7-dimethoxyphthalazinone, and 2,3-dihydro- 1,4-phthalazinedione; a combination of phthalazine plus one or more phthalic acid derivatives such as phthalic acid, 4-methylphthalic acid, 4-nitrophthalic acid, and tetrachlorophthalic anhydride, quinazolinediones, benzoxazine or naphthoxazine derivatives; rhodium complexes functioning not only as tone modifiers but also as sources of halide ion for silver halide formation in situ, such as ammonium hexachlororhodate (III), rhodium bromide, rhodium nitrate, and potassium hexachlororhodate (III); inorganic peroxides and persulfates such as ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines such as 2,4-dihydroxypyrimidine, 2-hydroxy- 4-aminopyrimidine, and azauracil; and tetrazapentalene derivatives such as 3,6-dimercapto-1,4-diphenyl-1H, 4H-2,3a,5,6a-tetrazapentalene and 1,4 -di-(o-chlorophenyl)-3,6-dimercapto-1H,4H-2,3a,5,6a-tetrazapentalene.

The photothermographic elements used in this invention can be further protected against the additional production of fog and can be stabilized against loss of sensitivity during storage. While not necessary for the practice of the invention, it may be advantageous to add mercury (II) salts to the emulsion layer(s) as an antifoggant. Preferred mercury (II) salts for this purpose are mercuric acetate and mercuric bromide.

Other suitable antifoggants and stabilizers, which can be used alone or in combination, include the thiazolium salts described in U.S. Pat. Nos. 2,131,038 and 2,694,716; the azaindenes described in U.S. Pat. No. 2,886,437; the triazaindolizines described in U.S. Pat. No. 2,444,605; the mercury salts described in U.S. Pat. No. 2,728,663; the urazoles described in U.S. Pat. No. 3,287,135; the oximes described in British Patent No. 623,448; the polyvalent metal salts described in U.S. Pat. No. 2,839,405; the isothiourea compounds described in U.S. Pat. No. 3,220,839; and palladium, platinum and gold salts described in U.S. Pat. Nos. 2,566,263 and 2,597,915.

Photothermographic elements of the invention can contain plasticizers and lubricants such as polyalcohols and diols of the type described in U.S. Pat. No. 2,960,404; fatty acids or esters such as those described in U.S. Pat. Nos. 2,588,765 and 3,121,060; and silicone resins such as those described in British Patent No. 955,061.

The photothermographic elements of the present invention can also include image dye stabilizers. Such image dye stabilizers are illustrated by U.K. Patent No. 1,326,889; and U.S. Pat. Nos. 3,432,300; 3,574,627; 3,573,050; 3,764,337; and 4,042,394.

Photothermographic elements according to the present invention can be used in photographic elements that contain light-absorbing materials, antihalation, acutance, and filter dyes such as those described in U.S. Pat. Nos. 3,253,921; 2,274,782; 2,527,583; 2,956,879 and 5,266,452. If desired, the dyes can be mordanted, for example, as described in U.S. Pat. No. 3,282,699. They can also contain matting agents such as starch, titanium dioxide, zinc oxide, silica, and polymeric beads including beads of the type described in U.S. Pat. Nos. 2,992,101 and 2,701,245. Furthermore they can also contain antistatic or conducting layers, such as layers that comprise soluble salts, e.g., chlorides, nitrates, etc., evaporated metal layers, ionic polymers such as those described in U.S. Pat. No. 3,206,312 or insoluble inorganic salts such as those described in U.S. Pat. No. 3,428,451.

Development Accelerators

A development accelerator can be used to advantage in the photothermographic elements of the present invention as well. A development accelerator can be an electron transfer agent, a radical scavenger, a hydrogen donor, or a hydrazide codeveloper, for example.

Suitable development accelerators are those that are capable of being oxidized by a silver salt to form an oxidized product that has the ability to oxidize the hydrazide dye reducing agent (as with an electron transfer agent) or hydrogen atom donors that quench by-products of the hydrizide dye reducing agent which minimize reduction. Preferably, the development accelerators are mobile. Examples of suitable such development accelerators are hydroquinone, alkyl-substituted hydroquinones such as t-butylhydroquinone and 2,5-dimethylhydroquinone, catechols, pyrogallols, halogen-substituted hydroquinones such as chlorohydroquinone and dichlorohydroquinone, alkoxy-substituted hydroquinones such as methoxyhydroquinone, polyhydroxybenzene derivatives such as methyl gallate, ascorbic acid, ascorbic acid derivatives, hydroxylamines such as N,N' -di-(2-ethoxyethyl)hydroxylamine, pyrazolidones, aminophenols, phenylenediamines, as well as hydroxyfluoronone benzhydrol, and $N^2$-tosylbenzhydrazide. Other suitable development accelerators are the electron transfer agents are disclosed in U.S. Pat. Nos. 5,139,919 and 5,156,939. Preferred electron transfer agents are pyrazolidinones and hydroquinones.

Photothermographic Constructions

The photothermographic elements of this invention can be constructed of one or more layers on a support. Single layer constructions should contain the silver halide, the non-photosensitive, reducible silver source material, the hydrazide redox-dye-releasing (RDR) compound, and binder as well as optional materials such as toners, coating aids, and other adjuvants. Two-layer constructions should contain silver halide and non-photosensitive, reducible silver source in one emulsion layer (usually the layer adjacent to the support) and some of the other ingredients in the second layer or both layers, although two layer constructions comprising a single emulsion layer coating containing all the ingredients and a protective topcoat are envisioned. Multicolor photothermographic dry silver constructions can contain sets of these bilayers for each color or they can contain all ingredients within a single layer, as described in U.S. Pat. No. 4,708,928. In the case of multilayer, multicolor photothermographic elements, the various emulsion layers are generally maintained distinct from each other by the use of functional or non-functional barrier layers between the various photosensitive layers, as described in U.S. Pat. No. 4,460,681.

Photothermographic emulsions used in this invention can be coated by various coating procedures including wire wound rod coating, dip coating, air knife coating, curtain coating, or extrusion coating using hoppers of the type described in U.S. Pat. No. 2,681,294. If desired, two or more layers can be coated simultaneously by the procedures described in U.S. Pat. No. 2,761,791 and British Patent No. 837,095. Typical wet thickness of the emulsion layer can be about 10–100 micrometers (μm), and the layer can be dried in forced air at a temperature of about 20°–100° C. It is preferred that the thickness of the layer be selected to provide maximum image densities greater than about 0.2, and, more preferably, in the range of about 0.5 to 2.5, as measured by a MacBeth Color Densitometer Model TD 504 using the color filter complementary to the dye color.

Additionally, it may be desirable in some instances to coat different emulsion layers on both sides of a transparent support, especially when it is desirable to isolate the imaging chemistries of the different emulsion layers.

Barrier layers, preferably comprising a polymeric material, can also be present in the photothermographic element of the present invention. Polymers for the material of the barrier layer can be selected from natural and synthetic polymers such as gelatin, polyvinyl alcohols, polyacrylic acids, sulfonated polystyrene, and the like. The polymers can optionally be blended with barrier aids such as silica. Alternatively, the formulation can be spray-dried or encapsulated to produce solid particles, which can then be redispersed in a second, possibly different, binder and then coated onto the support. The formulation for the emulsion layer can also include coating aids such as fluoroaliphatic polyesters.

Photothermographic emulsions used in the invention can be coated on a wide variety of supports. The support can be selected from a wide range of materials depending on the imaging requirement. Supports may be transparent or opaque. Typical supports include polyester film, subbed polyester film, polyethylene terephthalate film, cellulose nitrate film, cellulose ester film, polyvinyl acetal film, polycarbonate film and related or resinous materials, as well as glass, paper, metal, and the like. Typically, a flexible support is employed, especially a paper support, which can be partially acetylated or coated with baryta and/or an α-olefin polymer, particularly a polymer of an α-olefin containing 2 to 10 carbon atoms such as polyethylene, polypropylene, ethylene-butene copolymers, and the like. Preferred polymeric materials for the support include polymers having good heat stability, such as polyesters. A particularly preferred polyester is polyethylene terephthalate. A support with a backside resistive heating layer can also be used in color photothermographic imaging systems such as shown in U.S. Pat. Nos. 4,460,681 and 4,374,921.

The Dye-Receiving Layer

The photothermographic element can include a dye-receiving layer. Thermally mobile dyes derived from photothermographic elements employing hydrazide redox-dye-releasing compounds capable of being oxidized to release a thermally mobile dye typically migrate or are transferred to a dye-receiving or an image-receiving layer.

Dyes released during thermal development of light-exposed regions of the emulsion layers migrate under development conditions into an image-receiving, i.e., dye-receiving, layer wherein they are retained. The dye-receiving layer can be composed of a polymeric material having affinity for the dyes employed. Necessarily, it will vary depending on the ionic or neutral characteristics of the dyes.

The dye-receiving layer of this invention can be any flexible or rigid, transparent layer made of thermoplastic polymer. The dye-receiving layer preferably has a thickness of at least about 0.1 μm, more preferably about 1–10 μm, and a glass transition temperature ($T_g$) of about 20°–200° C. In the present invention, any thermoplastic polymer or combination of polymers can be used, provided the polymer is capable of absorbing and fixing the dye. The polymer may include dye mordants to fix the dye. Alternatively, the polymer itself may act as a dye mordant in which case no additional fixing agents are required. Thermoplastic polymers that can be used to prepare the dye-receiving layer include polyesters, such as polyethylene terephthalates; polyolefins, such as polyethylene; cellulosics, such as cellulose acetate, cellulose butyrate, and cellulose propionate; polystyrene; polyvinyl chloride; polyvinylidine chloride; polyvinyl acetate; copolymer of vinyl chloride-vinyl acetate; copolymer of vinylidene chloride-acrylonitrile; copolymer of styrene-acrylonitrile; and the like.

The dye-receiving layer can be prepared by dissolving at least one thermoplastic polymer in an organic solvent (e.g., 2-butanone, acetone, tetrahydrofuran) and applying the resulting solution to a support base (or substrate) by various coating methods known in the art, such as curtain coating, extrusion coating, dip coating, air-knife coating, hopper coating, and any other coating method used for coating solutions. After the solution is coated, the dye-receiving layer is dried (e.g., in an oven) to drive off the solvent. The dye-receiving layer can be a permanent part of the construction or it can be removable, as a separate sheet. When an integral part of the photothermographic element it is usually separated from the photothermographic emulsion layers by an opacifying layer. Alternatively, the dye-receiving layer can be strippably adhered to the photothermographic element and subsequently peeled from the construction. Strippable dye-receiving layers are described in U.S. Pat. No. 4,594,307.

Selection of the binder and solvent to be used in preparing the emulsion layer significantly affects the strippability of the dye-receiving layer from the photosensitive element. Preferably, the binder for the image-receiving layer is impermeable to the solvent used for coating the emulsion layer(s) and is incompatible with the binder used for the emulsion layer(s). The selection of the preferred binders and solvents results in weak adhesion between the emulsion layer and the dye-receiving layer and promotes good strippability of the emulsion layer. Alternatively, the layer(s) to be in contact with the receiving layer can be applied by lamination rather than solvent coating.

The photothermographic element can also include coating additives to improve the strippability of the emulsion layer. For example, fluoroaliphatic polyesters dissolved in ethyl acetate can be added in an amount of about 0.02–0.5 weight percent of the emulsion layer, preferably about 0.1–0.3 weight percent, A representative example of such a fluoroaliphatic polyester is "Fluorad™ FC 431" (a fluorinated surfactant available from Minnesota Mining and Manufacturing Company, St. Paul, Minn.). Alternatively, a coating additive can be added to the dye-receiving layer in the same weight range to enhance strippability. No solvents need to be used in the stripping process. The strippable layer preferably has a delaminating resistance of about 1–50 g/cm and a tensile strength at break greater than, preferably at least two times greater than, its delaminating resistance.

Preferably, the dye-receiving layer is adjacent to the emulsion layer in order to facilitate transfer of the dye that is released after the imagewise exposed emulsion layer is subjected to thermal development, for example, in a heated shoe-and-roller-type or heated drum-type heat processor.

Development conditions will vary, depending on the construction used, but will typically involve heating the imagewise exposed material at a suitably elevated temperature. When used in a photothermographic element, the latent image obtained after exposure of the heat-sensitive construction can be developed by heating the material at a moderately elevated temperature of, for example, about 80°–250° C., preferably about 120°–200° C., for a sufficient period of time, generally about 1 second to about 2 minutes. Heating may be carried out by the typical heating means such as a hot plate, an iron, a hot roller, a heat generator using carbon or titanium white, or the like.

In some methods, the development is carried out in two steps. Thermal development takes place at a higher temperature, e.g., about 150° C. for about 10 seconds, followed by thermal diffusion at a lower temperature, e.g., about 80° C., in the presence of a transfer solvent. The second heating step at the lower temperature prevents further development and allows the dyes that are already released to diffuse out of the emulsion layer to the receptor layer.

Photothermographic multi-layer constructions containing blue-sensitive emulsions containing a redox-yellow-dye-releasing compound can be overcoated with green-sensitive emulsions containing a redox-magenta-dye-releasing compound. These layers can in turn be overcoated with a red-sensitive emulsion layer containing a redox-cyan-dye-releasing compound. Imaging and heating release the yellow, magenta, and cyan dyes in an imagewise fashion. Color-releasing layers can be maintained distinct from each other by the use of functional or non-functional barrier layers between the various photosensitive layers as described in U.S. Pat. No. 4,460,681. False color address, such as that shown in U.S. Pat. No. 4,619,892, can also be used rather than blue-yellow, green-magenta, or red-cyan relationships between sensitivity and dye-release. False color address is particularly useful when imaging is performed using longer wavelength light sources, especially red or near infrared light sources, to enable digital address by lasers and laser diodes. The dyes so released may migrate to a dye-receiving layer.

If desired, the colored dyes released in the emulsion layer can be transferred onto a separately coated dye-receiving sheet by placing the exposed emulsion layer in intimate face-to-face contact with the dye-receiving sheet and heating the resulting composite construction. Good results can be achieved in this second embodiment when the layers are in uniform contact for a period of time of about 0.5–300 seconds at a temperature of about 80°–250° C.

In another embodiment, a multi-colored image can be prepared by superimposing in register a single dye-receiving sheet successively with two or more imagewise exposed photothermographic elements, each of which releases a dye of a different color, and heating to transfer the thus released dyes as described above. This method is particularly suitable for the production of color proofs especially when the dyes released have hues that match the internationally agreed standards for color reproduction. These are known as Standard Web Offset Printing or SWOP colors. Dyes with this property are disclosed in U.S. Pat. No. 5,023,229. In this embodiment, the photothermographic elements are preferably all sensitized to the same wavelength range regardless of the color of the dye released. For example, the elements can be sensitized to ultraviolet radiation with a view toward contact exposure on conventional printing frames, or they can be sensitized to longer wavelengths, especially red or near infra-red, to enable digital address by lasers and laser diodes. As noted above, false color address is again particularly useful when imaging is performed using longer wavelength light sources, especially red or near infrared light sources, to enable digital address by lasers and laser diodes.

Objects and advantages of this invention will now be illustrated by the following examples, but the particular materials and amounts thereof recited in these examples, as well as other conditions and details, should not be construed to unduly limit this invention.

EXAMPLES

All materials used in the following examples were readily available from standard commercial sources, such as Aldrich Chemical Co. (Milwaukee, Wis.) unless otherwise specified. All percentages are by weight unless otherwise indicated.

Speed 1 is the log exposure (in ergs) corresponding to a density of 0.2 above Dmin.

Speed 2 is the log Exposure (in ergs) corresponding to a density of 0.60 above Dmin.

Contrast is the slope of a line joining the density points at 0.3 to 0.9 above Dmin.

Dabsyl chloride is 4-(dimethylamino)azobenzene-4'-sulfonyl chloride t-BOC is tert-butoxycarbonyl (t-Bu—O—C(O)—).

Preparation of Redox-Dye-Releasing Compounds

Compound I

The synthetic route to Redox-Dye-Releasing Compound I involved the reaction between octanoic hydrazide and dabsyl chloride as follows:

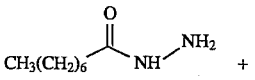

-continued

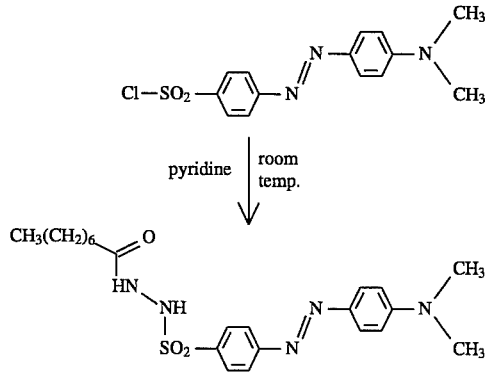

To a stirred solution of octanoic hydrazide (0.29 g, 1.48 mmoles, 80% purity) in 2 mL pyridine at room temperature was added dabsyl chloride (0.50 g, 1.48 mmoles, 96% purity). After stirring for 2.5 hours, the reaction mixture was poured into water and the resulting orange precipitate filtered and washed with water, 0.1N HCl, and again with water until the washings were at a pH of 7. After air drying, 0.49 g (74%) of Redox-Dye-Releasing Compound I was obtained. Spectral data agreed with the proposed structure. The sample could be further purified by recrystallization from toluene. When run on a larger scale, the addition of dabsyl chloride was done at 0° C., and then the reaction mixture was allowed to come to room temperature.

Compound II

To a stirred solution of stearic hydrazide in (9.20 g, 3.08 mmoles) 30 mL of pyridine at room temperature was added dabsyl chloride (1.00 g, 3.08 mmoles). After stirring for 6 hours, the reaction mixture was poured over ice water and the precipitate filtered, washed, and crystallized with methanol to give 1.41 g (78%) of Redox-Dye-Releasing Compound II. Spectral data were consistent with the proposed structure.

Compound III

Into a 250 mL Erlenmeyer flask equipped with a magnetic stir bar were placed p-anisidine (12.3 g, 99.5 mmoles) and a mixture of 26 mL concentrated HCl and 30 mL water. The stirring mixture was heated using a steam bath until the p-anisidine had completely dissolved. The solution was cooled to a temperature between −5° C. and −15° C. using a salt-ice water bath. To this was added dropwise a solution of 7 g (101 mmoles) of sodium nitrite in 35 mL water. After stirring for 30 minutes at a temperature between −5° C. and −15° C., N-ethyl-N-(β-hydroxyethyl)-m-toluidine (18 g, 100.16 mmoles) was added to the reaction vessel, followed by the dropwise addition of a solution of 37 g of sodium acetate in 100 mL water. One hour after addition of the aqueous sodium acetate solution was completed, the ice bath was removed and the contents of the Erlenmeyer flask was filtered using a Buchner funnel. The filter cake was washed with cold water. The product was purified by recrystallization from absolute ethanol to give 18.4 g (58.7 mmoles, 59% yield) of yellow crystals of the dye 4-(4'-methoxyphenylazo)-3-methyl-N-ethyl-N-(β -hydroxyethyl)aniline (melting point= 101° C.).

A flame-dried 25 mL two-necked flask equipped with a magnetic stir bar, a thermometer, and an addition funnel capped with a nitrogen inlet tube was charged with of 4-(chlorosulfonyl)phenyl isocyanate (1 g, 4.6 mmoles) and 5 mL dichloromethane. The contents of the flask were cooled to 0° C. with stirring under a nitrogen atmosphere. The dye 4-(4'-methoxyphenylazo)-3-methyl-N-ethyl-N-(β -hydroxyethyl)aniline (11.4 g, 4.6 mmoles) was dissolved in a minimum amount of dichloromethane and added via the addition funnel dropwise to the solution of the isocyanate at a rate sufficient to maintain a reaction temperature of between about 0° C. and 5° C. After addition of the aniline dye solution was complete, the reaction apparatus was allowed to stand at 0° C. overnight. The mixture was exposed to a vacuum to remove the solvent from this resultant dye-sulfonyl chloride intermediate, the structure of which is shown below.

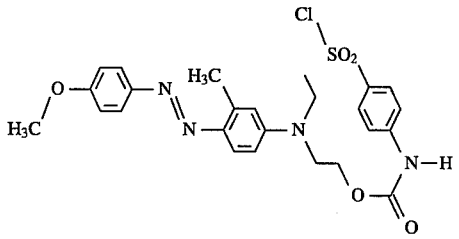

A 25 mL flask equipped with a magnetic stir bar and a nitrogen inlet tube was charged with 3-(4-hydroxyphenyl-)propionic acid hydrazide (0.72 g, 4 mmoles obtained from Maybridge Chemical Co.) and 5 mL pyridine to make a slurry. The dye-sulfonyl chloride intermediate (1.81 g, 4 mmoles) was added to this slurry while under a nitrogen atmosphere at room temperature. The reaction contents were stirred overnight and then poured into 25 mL water and cooled to 0° C. The solid was collected by filtration and the filter cake washed with dilute hydrochloric acid and then with water until the filtrate was colorless. The solid was purified using flash chromatography on silica gel using dichloromethane/ethyl acetate as the solvent system to give 1.4 g (2.4 mmoles, 60% yield) of Redox-Dye-Releasing Compound III. Spectral data were consistent with the proposed structure.

Compound IV

To a stirred slurry of 4-hydroxybenzoic hydrazide (7.6 g, 0.050 mole) at 0° C. in 50 mL pyridine was added tosyl chloride (9.55 g, 0.050 mole). After stirring at 0° C. for 2 hours, the mixture was allowed to come to room temperature. Water was then added to the product. After stirring overnight, the product was filtered, washed with water, dilute HCl, and again with water. The product was then air dried and recrystallized from methanol-water. A second batch was obtained by concentrating the mother liquor for a combined yield of 9.76 g (64%) of the intermediate shown below. Spectral data were consistent with the proposed structure.

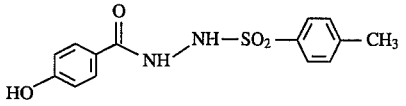

To a stirred solution of 0.946 g (3.10 mmol) of this intermediate compound in 15 mL tetrahydrofuran containing 0.45 mL triethylamine was added 1.00 g (3.10 mmol) of dabsyl chloride. After stirring at room temperature for 2 hours, dichloromethane was added and extracted with water. The organic layer was washed with dilute aqueous potassium carbonate, dilute HCl, and then water. It was then dried with sodium carbonate, which was removed by filtration, and concentrated under vacuum to give a red semi-solid, which was crystallized with methanol and filtered to give 0.31 g of Redox-Dye-Releasing Compound IV. Spectral data were consistent with the proposed structure.

Compound V

To a stirred solution of 4-hydroxyhydrocinnamic acid hydrazide (2.00 g, 0.028 mole) in 10 mL pyridine at 0° C. was added tosyl chloride (5.29 g, 0.028 mole). The reaction mixture was allowed to stir at room temperature overnight. Water was then added and the precipitate was filtered and washed with water, dilute HCl, and again with water. After recrystallizing from methanol-water, 2.90 g of the intermediate shown below was obtained. Spectral data were consistent with the proposed structure.

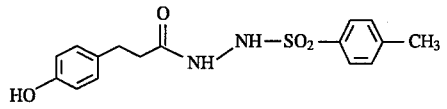

To a solution of this intermediate (1.04 g, 3.10 mmoles) in 25 mL tetrahydrofuran containing 0.5 mL triethylamine was added dabsyl chloride (1.00 g, 3.10 mmoles). The reaction was worked-up as described in Example __ above to afford 0.70 g of Redox-Dye-Releasing Compound V. Spectral data were consistent with the proposed structure.

Compound VI

To a slurry of dodecanoic acid hydrazide (260 mg, 121 mmoles) in 5 mL pyridine at room temperature was added dabsyl chloride (393 mg, 1.21 mmoles). After stirring at room temperature overnight, water was added and the product filtered, washed with water, and recrystallized from wet methanol to give 0.18 g of Redox-Dye-Releasing Compound VI. Spectral data were consistent with the proposed structure.

Compound VII

8-Bromo-1-tetrahydropyranyloxyoctane (14.7 g), methyl 4-hydroxyphenylacetate (8.3 g), and cesium carbonate (24 g) were dissolved or suspended in THF (200 mL). After 24 hours of refluxing, the reaction was cooled and poured onto cold water (2.5 L). The organic layers were washed with water (1×500 mL) and brine (1×500 mL). The solution was dried using $MgSO_4$, and the solvent evaporated to produce 20.25 g (105%) of methyl 4-(8'-tetrahydropyranyloxyoctyl-1'-oxy)phenyl acetate (thin layer chromatography showed slight contamination with methyl 4-hydroxyphenyl acetate).

4-(8'-Tetrahydropyranyloxyoctyl-1'-oxy)phenyl acetate (20.25 g) was dissolved in ethanol (50 mL) and hydrazine hydrate (18 mL) was added. More ethanol (25 mL) was added to assist in the addition of the hydrazine hydrate. After 2 hours of reflux, the mixture was allowed to cool to room temperature overnight. The addition of water produced a precipitate of 4-(8'-tetrahydropyranyloxyoctyl- 1'-oxy)phenyl acethydrazide (13.51 g, 71% yield) that was collected by filtration and washed with a 50:50 ethanol:water mixture.

4-(8'-Tetrahydropyranyloxyoctyl-1'-oxy)phenyl acethydrazide (6.4 g) was dissolved in pyridine (40 mL). The solution was cooled to 0° C. and dabsyl chloride (5.45 g) was added in portions over a period of 55 minutes. After a further 35 minutes stirring at 0° C., the mixture was poured into water (600 mL). A dark oil formed, which separated out and crystallized with scratching. The solid was collected by filtration, washed with water, and air dried to yield 10.62 g (94%) of $N^2$-4'''-dimethylaminoazobenzene-4" -sulfonyl-4-(8' -tetrahydropyranyloxyoctyl- 1'-oxy)phenyl acethydrazide.

$N^2$-4'''-dimethylaminoazobenzene-4" -sulfonyl-4-(8' -tetrahydropyranyl oxyoctyl-1'-oxy)phenyl acethydrazide (15.48 g) was suspended in methanol (100 mL). Toluene sulfonic acid (0.87 g) was added and the solution was refluxed for 1.5 hours. The nature of the precipitate changed during this period. The reaction was cooled to room temperature and then on ice. The product was collected by filtration, and then washed with methanol followed by ether to yield 12.64 g (93%) of $N^2$-4'''-dimethylaminoazobenzene-4''-sulfonyl-4-(8'-hydroxyoctyl-1'-oxy)phenyl acethydrazide (Redox-Dye-Releasing Compound VII). $^1H$ and $^{13}C$ NMR spectra agreed with the assigned structure.

Compound VIII 4-(8'-Tetrahydropyranyloxyoctyl-1'-oxy)phenyl acethydrazide (1.1 g, prepared as described above in the preparation of Compound VII) and 2'-hydroxy- 1'-naphthylazophenyl-4-sulfonyl chloride (1.0 g) (prepared by the method of Sokolowska-Gajda, *Dyes and Pigments,* 1990, p. 35–48, which is incorporated herein by reference) were stirred together in pyridine (25 mL) at 0° C. for 2 hours. The product ($N^2$-2'''-hydroxy-1'''-naphthylazophenyl-4'''-sulfonyl-4-(8' -tetrahydropyranyloxyoctyl-1'-oxy)phenyl acethydrazide) was collected by filtration and dried under vacuum yielding 1.9 g (96%).

$N^2$-2'''-hydroxy-1'''-naphthylazophenyl-4'''-sulfonyl-4-(8' -tetrahydropyranyloxyoctyl-1'-oxy)phenyl acethydrazide (1.9 g) was dissolved in methanol (20 mL) and dimethyl formamide (2 mL). Amberlyst resin (1 g) was added and the mixture warmed to 50° C. for 1 hour. After cooling the solution was decanted from the resin and poured into water. The product was collected by filtration, washed with water, and dried under vacuum to produce 1.4 g (84%) of $N^2$-2'''-hydroxy- 1'''-naphthylazophenyl-4''-sulfonyl-4-(8'-hydroxyoctyl-1'-oxy)phenyl acethydrazide (Redox-Dye-Releasing Compound VIII).

Compound IX

11-Bromoundecan-1,2-diol (2.65 g) was dissolved in 2,2-dimethoxypropane (10 mL) and acetone (20 mL) which had been dried over anhydrous $K_2CO_3$ for 1 hour. Toluene sulfonic acid (0.18 g) was added and the reaction stirred at room temperature for 19 hours. Solid $K_2CO_3$ was added and the mixture was stirred for 30 minutes. The solid was filtered off and the solvent evaporated. The product (11-bromoundecan-1,2-diol acetonide) was isolated in 79% yield (2.42 g) by flash chromatography on $Sio_2$ with $CH_2Cl_2$.

11-Bromoundecan-1,2-diol acetonide (2.42 g), methyl 4-hydroxyphenylacetate (1.31 g) and cesium carbonate (3.9 g) were suspended or dissolved in THF (35 mL). After 48 hours at reflux, the reaction mixture was left at room temperature for the weekend. The liquid was decanted from the solid, which was washed with ether. The combined solutions were evaporated to dryness and run through a $Sio_2$ column using $CH_2Cl_2$ as the solvent. The product (methyl 4-(10',11'-dihydroxyundecan-1'-oxy)phenylacetate acetonide) was isolated as a mobile oil in 93% yield (2.74 g).

Methyl 4-(10',11'-dihydroxyundecan-1'-oxy)phenyl acetate acetonide (2.74 g) was partly dissolved in ethanol (10 mL) with hydrazine hydrate (3 mL). After 3.5 hours heating, the reaction was removed from the heat and water (10 mL) was added. As the reaction cooled down, crystallization occurred. The product (4-(10',11'-dihydroxyundecan-1'-oxy)phenyl acethydrazide acetonide) was collected by filtration and washed with water yielding 3.46 g (84%).

4-(10',11'-Dihydroxyundecan-1'-oxy)phenyl acethydrazide acetonide (7.0 g) and 2'-hydroxy-1'-naphthylazophenyl-4-sulfonyl chloride (6.2 g) (prepared by the method of Sokolowska-Gajda, *Dyes and Pigments,* 1990, p. 35–48, which is incorporated herein by reference) were stirred together in pyridine (200 mL) at 0° C. for 2 hours. The product ($N^2$-2'''-hydroxy-1'''-naphthylazophenyl-4''-sulfonyl- 4-(10',11'-dihydroxyundecan-1'-oxy)phenyl acethydrazide acetonide) was collected by filtration and dried under vacuum yielding 9.9 g (75%).

$N^2$-2'''-hydroxy-1'''-naphthylazophenyl-4''-sulfonyl-4-(10',11' -di-hydroxyundecan-1'-oxy)phenylacethydrazide acetonide (9.9 g) was deprotected by stirring with Amberlyst resin (2 g) in dimethyl formamide (150 mL) and methanol (10 mL) for 10 hours at 50° C. The solution was decanted from the resin while still warm and poured into water (500 mL). The product was collected by filtration, washed with water, combined with ethanol (300 mL) with stirring, and dried to yield 7.0 g (71%) of $N^2$-2'''-hydroxy-1'''-naphthylazophenyl-4''-sulphonyl-4 -(10',11' -dihydroxyundecan-1'-oxy)phenylacethydrazide (Redox-Dye-Releasing Compound IX).

Compound X 4-(10',11'-Dihydroxyundecan-1'-oxy)phenyl acethydrazide acetonide (2.38 g) was dissolved in pyridine (15 mL). Dabsyl chloride (1.96 g) was added in portions over 35 minutes at 0° C. After a further 40 minutes at 0° C., the mixture was poured into ice/water (200 mL). A dark oil separated which eventually crystallized. The solid was collected by filtration and washed with water before air drying to produce $N^2$-4'''-dimethylaminoazobenzene-4''-sulfonyl-4-(10',11'-dihydroxyundecan- 1'-oxy)phenylacethydrazide acetonide in 84% yield (3.46 g).

This product (3.46 g) was partly dissolved in methanol (15 mL). Toluene sulfonic acid (0.1 g) was added and the reaction refluxed for 90 minutes. It was then allowed to cool to room temperature whereupon crystallization occurred. Filtration and washing with methanol and ether left a sticky solid. The product was eventually isolated from the solid and the liquors by chromatography on $SiO_2$ using $Et_2O$ followed by EtOAc. $N^2$-4'''-Dimethylaminoazobenzene-4''-sulfonyl-4-(10',11'-dihydroxyundecan-1'-oxy)phenylacethydrazide (Redox-Dye-Releasing Compound X) was produced in 46% yield (1.49 g). Spectral data were consistent with the proposed structure.

Compound XI

A solution of 11-bromoundecanoic acid (26.5 g, 0.1 mole) in anhydrous dichloromethane (150 mL) was cooled to 0° C. p-Aminostyrene (12 g, 0.1 mole) was added rapidly with stirring. Dicyclohyexylcarbodiimide (21 g, 0.1 mole) in a solution of anhydrous dichloromethane was then added over 60 minutes, keeping the temperature about 0° C. A further 50 mL of anhydrous dichloromethane was then added in order to facilitate efficient stirring. The mixture was allowed to reach room temperature and stirred overnight. The urea by-product was filtered off and washed with dichloromethane. These washings and the filtrate were combined, and washed with dilute acid followed by water. The solution was subsequently dried with magnesium sulfate and the dichloromethane removed to leave a white solid. This solid was stirred with 500 mL of ether and filtered to obtain a first batch of product. The ether volume was then reduced to 200 mL and a second crop collected. The total yield of N-4'-styryl-11-bromoundecanamide was 20.2 g (55%). Spectral data ($^1H$ NMR) was consistent with the proposed structure.

To a solution of 4-hydroxybenzhydrazide (1.52 g, 0.01 mole) in anhydrous dimethylsulfoxide (DMSO), under an atmosphere of argon, was added cesium carbonate (3.56 g, 1.1 equivalents) with stirring. A solution of N-4'-styryl-11-bromoundecanamide (3.66 g, 0.01 mole) in anhydrous DMSO (20 mL) was then added over 20 minutes. The mixture was stirred at room temperature for 1 hour, followed by heating at 70° C. for 5 hours with stirring, after which it was left to cool overnight. The mixture was poured into water and the crude solid product recovered by filtration. This was then recrystallized using methanol. $^1H$ NMR was consistent with 4-(N'-4''-styryl-1'-oxyundecanamide)benzhydrazide, which was obtained in 50% yield.

A solution of 4-(N'-4''-styryl-1'-oxyundecanamide)benzhydrazide (2 g, 4.58 mmol) in anhydrous pyridine (30 mL)

in a dry, argon filled, 3-necked flask was cooled to 0° C. To this was added, with stirring, a slurry of dabsyl chloride (1.55 g, 1.05 equivalents) in anhydrous pyridine over 30 minutes. After reaching room temperature, the reaction appeared complete by TLC (thin layer chromatography). The reaction mixture was therefore poured into water and extracted using dichloromethane. The dichloromethane solution was passed through a plug of HYFLO supercel filter aid (obtained from BDH Laboratory Supplies, Lutterworth, UK), washed with water, and dried over magnesium sulfate before the dichloromethane was removed to leave an orange solid. $^1$H NMR was consistent for N$^2$-4''''-dimethylaminoazobenzene-4'''-sulfonyl-4-(N'-4''-styryl-1 -oxyundecanamide)benzhydrazide, which was obtained in 51% yield (1.7 g).

Butyl methacrylate (0.8 g) and N$^2$-4''''-dimethylaminazobenzene- 4'''-sulfonyl-4-(N'-4''-styryl-1-oxyundecanamide)benzhydrazide (0.2 g) were placed in an argon-filled 50 mL polymerization jar. Tetrahydrofuran (3 mL) and AIBN (0.01 g) were added. The mixture was flushed with argon and the bottle sealed, before placing it in a water bath at 65° C. overnight. The polystyrene hydrazide/butyl methacrylate copolymer (Redox-Dye-Releasing Compound XI) was isolated by precipitation into methanol in a yield of 0.7 g (70%). Both TLC and GPC (gel permeation chromatography) indicated the absence of monomer. Mw= 207,000; PD= 5.83; Tg= 54° C.

Compound XII

A solution of 8.52 g (0.0313 mol) of 14-hydroxypentadecanoic acid hydrazide in 150 mL of anhydrous pyridine was treated with 10 g (0.0313 mol) of dabsyl chloride over 15 minutes. This was stirred at room temperature for (20°–25° C.) 1.5 hours, then heated at 60° C. for 3 hours. The reaction mixture was poured into excess water to precipitate the product, which was filtered off using a cotton pad. The crude product (15.9 g) was boiled with 450 mL of methyl ethyl ketone and the undissolved solid was filtered off while hot. The volume of methyl ethyl ketone was reduced to about 100 mL and then cooled in a refrigerator (T= 5° C.). The product was collected by filtration and dried under vacuum at 80° C. to yield 12.8 g (73%) of N$^2$-4''-dimethylaminoazobenzene-4'-sulphonyl-15-hydroxypentadecanoic acid hydrazide (Redox-Dye-Releasing Compound XII).

Compound XIII

To a solution of N$^2$-4'''-Dimethylaminoazobenzene-4''-sulfonyl- 4-(10',11'-dihydroxyundecan-1'-oxy)phenyl acethydrazide (Redox-Dye-Releasing Compound X) (1.21 g, 1.89 mmol) in anhydrous methyl ethyl ketone (10 mL) in a dry, argon-filled, 3-necked flask, was added 1,6-diisocyanatohexane (0.32 g, 1.0 equivalent). The mixture was stirred at room temperature for 50 minutes, with 3 mL of anhydrous solvent being added to aid stirring, before a catalytic amount of dibutyltin dilaurate was added and the temperature raised to 80° C. The reaction was followed using GPC and IR. Although IR studies indicated the presence of free isocyanate, the molecular weight remained low. After stirring the mixture at elevated temperature (80° C.) for approximately 100 hours it was cooled to room temperature and the resulting slurry poured into methanol and filtered. TLC revealed the absence of the starting diol. The resultant product (Redox-Dye-Releasing Compound XIII) was isolated in 46% yield (0.71 g). Mw= 4166; PD= 2.69.

Preparation of N$^2$-tosylbenzhydrazide

Benzhydrazide (4.08 g) was dissolved in pyridine (25 mL) and cooled on ice. Tosyl chloride (5.72 g) was added portionwise over 5 minutes. Stirring was maintained at 0° C. for 15 minutes. Stirring at room temperature for 18 hours was followed by pouring into dilute HCl (650 mL). The resultant precipitate was filtered off, washed with water, and recrystallized from hot ethanol/water to afford 6.76 g of product as fine white needles.

"Dry Silver" Photothermographic Constructions

Example 1

A photothermographic construction was prepared using RDR Compound I. This construction consisted of a filled polyester (sold under the tradename Melinex™ 994 by ICI, Wilmington, Del.) base on which was coated a photothermographic silver layer using a wet coating orifice of 3 mils. The layer was dried for 4 minutes at 180° F. (82° C.).

Photographic Silver Layer: A dispersion of a silver behenate half soap was homogenized to 10% solids in a mixture of ethanol and toluene (90:10) and 0.5% polyvinyl butyral (Butvar™ B-76). To 205 g of the silver half soap dispersion was added 285 g of ethanol. After 10 minutes of mixing, 6.0 mL of a mercuric bromide solution (0.36 g/20 mL methanol) was added. Then 8.0 mL of a zinc bromide solution (0.45 g/20 mL methanol) was added 3 hours later. After an additional 1 hour of mixing, 26 g of polyvinyl butyral (Butvar™ B-72) was added. After another 1 hour of mixing, Fluorad™ FC-431 fluorocarbon surfactant (1.0 g/ 10.0 mL methanol) was added. To 64.2 g of this silver solution was added 4.0 mL of the red sensitizing dye shown below (0.0056 g/36.6 mL toluene and 13.4 mL methanol, prepared according to U.S. Pat. No. 3,719,495, which is incorporated herein by reference). This solution is referred to herein as the red-sensitized silver premix.

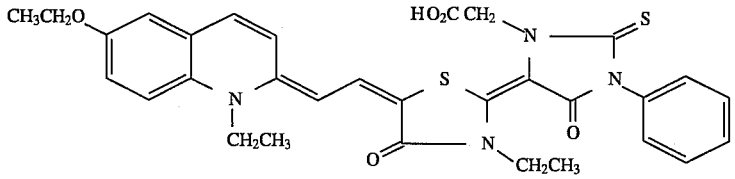

After 30 minutes, a solution containing the hydrazide yellow dye-releasing compound ($2.73\times10^{-4}$ moles of RDR Compound I), tetrahydrofuran (2.5 mL), and phthalazinone (0.07 g), was added to 8.43 g of the red-sensitized silver premix. This resultant solution is referred to herein as the silver halide solution.

The coated material was exposed using a Xenon flash from an EG&G sensitometer for $10^{-3}$ seconds through a #25 Wratten red filter and a 0–3 continuous wedge. It was processed at 280° F. (138° C.) for 10, 20, 30, and 40 seconds. The sensitometric responses are shown below.

| Dwell Time | Donor Dmin | Dmax | Speed 2 | Contrast |
|---|---|---|---|---|
| 10 sec | R 0.07 | 0.20 | — | — |
| | G 0.40 | 0.53 | — | — |
| | B 1.77 | 2.00 | — | — |
| 20 sec | R 0.07 | 0.36 | — | — |
| | G 0.42 | 0.80 | — | — |
| | B 1.79 | 2.13 | — | — |
| 30 sec | R 0.07 | 0.59 | — | — |
| | G 0.39 | 1.47 | 2.15 | 1.90 |
| | B 1.73 | 2.12 | — | — |
| 40 sec | R 0.08 | 0.92 | 2.01 | — |
| | G 0.42 | 1.68 | 1.10 | 1.48 |
| | B 1.84 | 2.05 | — | — |

The unprocessed material was yellow in color because of the presence of the chromophore of the thermally mobile yellow dye of the Redox-Dye-Releasing Compound I. Therefore, a high yellow (blue selective numbers) Dmin number was observed in the donor (silver) coated layer. The blue and green selective numbers measured the cleaved dye color. The increased reduction of silver is observed with the red selective numbers. The photothermographic release of the yellow dye was observed with the 30 and 40 seconds dwell time samples. The silver layer was peeled from the support and a yellow image corresponding to the photoreduction of silver with hydrazide and the diffusion of the yellow dye was observed on this support. The sensitometric response is shown below for these samples.

| Dwell Time | Support Dmin | Dmax |
|---|---|---|
| 30 sec | R 0.07 | 0.08 |
| | G 0.08 | 0.10 |
| | B 0.12 | 0.16 |
| 40 sec | R 0.07 | 0.11 |
| | G 0.09 | 0.15 |
| | B 0.15 | 0.32 |

The release of dye also occurred faster with the addition on electron transfer agent such as phenidone.

Example 2

A second photothermographic construction was prepared using RDR Compound I. This construction consisted of a filled polyester (sold under the tradename Meliniex™ 994 by ICI, Wilmington, Del.) base on which was coated a photothermographic silver layer using a wet coating orifice of 3 mils. Each layer was dried for 4 minutes at 180° F. (82° C.).

Silver Layer: A dispersion of a silver behenate full soap containing pre-formed silver halide grains (0.05 μm grain size, 9.0 mole-% silver halide, and 98%:2% Br:I ratio of halides) was homogenized to 11.94% solids in a mixture of ethanol and toluene (90:10) and 0.48% polyvinyl butyral (Butvar™ B-76). To 200.0 g of the silver full soap dispersion was added 40.0 g of ethanol. After 10 minutes of mixing, an additional 32 g of the polyvinyl butyral (Butvar™ B-76) was added. Three aliquots (0.055 g each) of pyridinium hybrobromide perbromide were added after 30, 90, and 150 minutes of mixing. After a final 4 hours of mixing, 1.3 mL of a 10% calcium bromide solution in methanol was mixed for 60 minutes. To 45 g of this silver solution was added 6.0 mL of a red sensitizing dye (0.01 g in 36.6 mL toluene and 13.4 mL methanol solution) as described in Example 1.

After 30 minutes, a solution of yellow RDR Compound I ($4.0\times10^{-4}$ moles), 2-(4-chlorobenzoyl)benzoic acid (0.025 g), N,N-bis[2-(4,6-tribromomethyl- 1,3,5-triazino)-1,3-dipiperidino-propane ("Antifoggant-1", 0.01 g), and tetrahydrofuran (4.6 mL) was added to 6.69 g of the red-sensitized silver premix. Antifoggant-1 was prepared as described in U.S. Pat. No. 5,340,712 which is incorporated herein by reference. Its structure is shown below.

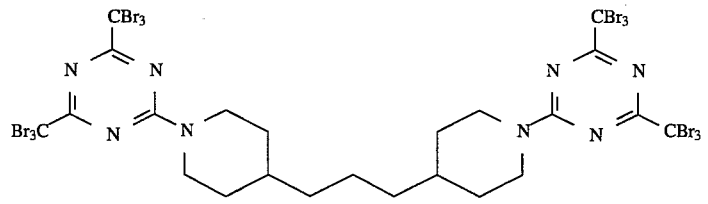

Antifoggant-1

The coated material was exposed using a red filter and processed at 280° F. (138° C.) for 30, 35, and 40 seconds. The samples were analyzed both with the silver layer and then peeled from the base and analyzed for photothermographic release of dye. The sensitometric response are shown below.

| Dwell Time | Donor Dmin | Dmax | Speed | Contrast |
|---|---|---|---|---|
| 30 sec | R 0.15 | 0.79 | 3.31 | — |
| | G 0.63 | 1.65 | 2.20 | — |
| | B 1.83 | 2.09 | — | — |
| 35 sec | R 0.26 | 1.10 | 2.37 | — |
| | G 0.77 | 1.82 | 1.54 | 1.12 |
| | B 1.98 | 2.11 | — | — |
| 40 sec | R 0.34 | 1.13 | 1.95 | — |
| | G 1.00 | 1.78 | 1.13 | — |
| | B 1.92 | 2.04 | — | — |

The increased reduction of silver was observed with the red selective numbers. The blue and green selective number measured the cleaved dye color. The unprocessed material was yellow in color because of the presence of the chromophore of the thermally mobile yellow dye of RDR Compound I. Therefore, a high yellow (blue selective number) Dmin was observed in the donor (silver) coated layer. The silver donor layer was peeled from the support. The yellow image corresponding to the cleaved dye from RDR Compound I by the photoreduction of silver was observed on the support. The results are shown below. The image became more dense with increased processing time.

| Dwell Time | Support Dmin | Support Dmax |
|---|---|---|
| 30 sec | R 0.06 | 0.08 |
| | G 0.08 | 0.10 |
| | B 0.14 | 0.18 |
| 35 sec | R 0.07 | 0.08 |
| | G 0.09 | 0.11 |
| | B 0.15 | 0.21 |
| 40 sec | R 0.07 | 0.08 |
| | G 0.09 | 0.12 |
| | B 0.16 | 0.25 |

The release of dye also occurred faster with the addition of a development accelerator such as phenidone.

Example 3

A photothermographic construction was prepared using RDR Compounds I and II. These constructions consisted of a filled polyester (sold under the tradename Melinex™ 994 by ICI, Wilmington, Del.) base on which was coated a receptor layer, a photothermographic silver layer, and a topcoat using a wet coating orifice of 3 mils. Each layer was dried for 4 minutes at 180° F. (82° C.).

Receptor Layer; The receptor layer contained 15% by weight VYNS™-3 (copolymer of vinyl chloride and vinyl acetate available from Union Carbide, Danbury, Conn.) in methyl ethyl ketone and toluene (50:50).

Silver Layer: The silver layer was the same as described in Example 1. To 8.43 g of the red sensitized silver premix was added $2.73\times10^{-4}$ moles of RDR Compound I or II and 0.07 g of phthalazinone (PAZ).

Topcoat: A topcoat solution was prepared by mixing 35.5 g of 5.9% cellulose acetate (obtained from Eastman Kodak under the product number CA 398-6), 8.0 g of polymethyl methacrylate (obtained from Rohm and Haas under the product name Acryloid™ A-21), 36.0 g of methanol, 98.0 g of 2-propanol, and 420 g of acetone.

These coated samples were exposed using a Xenon flash through a #25 Wratten filter or without a filter and a 0–3 continuous wedge using a EG&G sensitometer. The exposed materials were processed for 40 to 60 seconds at 280° F. (138° C.). The materials were analyzed both with the donor and receptor layers and after the donor layer was removed to analyze the cleaved dye in the receptor layer. The blue and green selective numbers measure the yellow dye color and the red selective number measures the reduction of the silver. The sensitometric response was measured and shown below.

| Sample | Filter | Dwell Time | Donor and Receptor Dmin | Donor and Receptor Dmax | Donor and Receptor Speed 1 | Receptor Dmin | Receptor Dmax |
|---|---|---|---|---|---|---|---|
| RDR I | No | 40 sec | R 0.15 | 0.50 | 2.71 | | |
| | | | G 0.64 | 1.09 | 1.42 | 0.29 | 0.32 |
| | | | B 2.56 | 2.80 | | 1.03 | 1.10 |
| | No | 50 sec | R 0.25 | 0.60 | 2.53 | | |
| | | | G 0.76 | 1.40 | | 0.28 | 0.34 |
| | | | B 2.54 | 2.73 | | 0.96 | 1.15 |
| | No | 60 sec | R 0.09 | 0.74 | 1.19 | | |
| | | | G 0.43 | 1.73 | | 0.23 | 0.38 |
| | | | B 1.93 | 2.81 | | 0.76 | 1.37 |
| RDR II | Yes | 40 sec | R 0.33 | 0.52 | | | |
| | | | G 0.78 | 1.73 | | 0.18 | 0.26 |
| | | | B 2.16 | 2.50 | | 0.58 | 0.73 |

The coated unprocessed material was yellow in color because of the yellow dye present on the hydrazide dye releasing compound and therefore, was present in the donor layer during sensitometric measurements. After exposure and processing, a photothermographic image was observed in the donor layer. After removal of the donor layer, a yellow image was observed in the receptor layer that corresponded to the imaged area of the donor indicating cleavage from the original hydrazide compound had occurred. The receptor had an overall yellow background because some diffusion of the original RDR Compounds I or II had diffused from the donor to the receptor. An increase in the yellow image in the receptor was observed with an increase in the dwell times during processing.

Example 4

As described in Example 3, $1.365\times10^{-4}$ moles of RDR Compound IV and 0.035 g of PAZ were added to a 8.43 g aliquot of the red sensitized silver premix. The material was coated, exposed, and processed as described in Example 3. With dwell times of 20 to 40 seconds, a photothermographic light yellow image was observed in the exposed region of the coating with a darker yellow background color from the unreacted RDR Compound IV in the unexposed areas of the donor layer.

Example 5

As described in Example 3, $2.73\times10^{-4}$ moles of RDR Compound V and 0.07 g of PAZ were added to a 8.43 g aliquot of the red sensitized silver premix. The material was coated, exposed, and processed as described in Example 3. After processing, a photothermographic yellow image was observed in the exposed region of the coating. Upon the removal of the donor layer, a light yellow image was observed in the receptor corresponding to the photoimaged silver donor layer. The sensitometric data is shown below.

| Sample | Filter | Dwell Time | Donor and Receptor Dmin | Donor and Receptor Dmax | Donor and Receptor Speed 1 |
|---|---|---|---|---|---|
| RDR V | No | 20 sec | R 0.09 | 0.38 | 2.86 |
| | | | G 0.85 | 1.12 | 2.42 |
| | | | B 2.50 | 2.73 | |
| | No | 30 sec | R 0.12 | 0.45 | 3.05 |
| | | | G 0.87 | 1.20 | 2.42 |
| | | | B 2.22 | 2.79 | |
| | No | 40 sec | R 0.13 | 0.53 | 2.49 |

-continued

| Sample | Filter | Dwell Time | Donor and Receptor Dmin | Dmax | Speed 1 |
|---|---|---|---|---|---|
| | | | G 0.89 | 1.30 | 2.27 |
| | | | B 2.53 | 2.78 | |

Example 6

As described in Example 3, $2.73\times10^{-4}$ moles of RDR Compound VI and 0.07 g of PAZ were added to a 8.43 g aliquot of the red sensitized silver premix. The material was coated, exposed, and processed as described in Example 3. A photothermographic yellow image was observed in the imaged area of the donor layer that was transferred to the receptor. The sensitometric response for this material is shown below.

| Sample | Filter | Dwell Time | Donor and Receptor Dmin | Dmax | Speed 1 | Receptor Dmin | Dmax |
|---|---|---|---|---|---|---|---|
| RDR VI | No | 40 sec | R 0.10 | 0.56 | 2.60 | | |
| | | | G 0.48 | 1.18 | 2.23 | 0.25 | 0.26 |
| | | | B 2.57 | 2.73 | | 0.75 | 0.82 |
| | No | 50 sec | R 0.13 | 0.60 | 2.31 | | |
| | | | G 0.51 | 1.28 | 1.86 | 0.25 | 0.29 |
| | | | B 2.51 | 2.66 | | 0.79 | 0.88 |

Example 7

As described in Example 3, RDR Compound I was studied with and without a development accelerator, 1-phenyl-3-pyrazolidinone (P). The electron transfer agent was added in an amount of 1.0 mL of 0.0021 g/50 mL methanol solution to the 8.43 g aliquot of the silver premix. The addition of 1-phenyl-3-pyrazolidinone alone added only a minimal effect on the reduction of the silver. The sensitometric data for these coatings are shown below.

| Sample | Filter | Dwell Time | Donor and Receptor Dmin | Dmax | SPD1 | Receptor Dmin | Dmax |
|---|---|---|---|---|---|---|---|
| RDR I and P | Yes | 30 sec | R 0.20 | 0.62 | 2.16 | | |
| | | | G 0.64 | 1.39 | 1.62 | 0.29 | 0.34 |
| | | | B 2.52 | 2.73 | | 0.99 | 1.20 |
| | Yes | 40 sec | R 0.51 | 0.82 | | | |
| | | | G 1.58 | 1.77 | | 0.30 | 0.38 |
| | | | B 2.53 | 2.73 | | 1.00 | 1.31 |
| P only | No | 40 sec | R 0.09 | 0.11 | | | |
| | | | G 0.09 | 0.13 | | | |
| | | | B 0.05 | 0.12 | | | |
| | Yes | 40 sec | R 0.08 | 0.11 | | | |
| | | | G 0.09 | 0.12 | | | |
| | | | B 0.04 | 0.11 | | | |

Example 8

As described in Example 3, $1.365\times10^{-4}$ moles of RDR Compound II and 0.035 g of PAZ (A), or $2.73\times10^{-4}$ moles of RDR Compound II and 0.07 g of PAZ (B) were added to the 8.43 g aliquot of the silver premix. As described in Example 7, both RDR Compound II and the development accelerator, 1-phenyl- 3-pyrazolidinone (P) were also added to a 8.43 g aliquot of the silver premix. As shown below, the addition of the development accelerator enhanced the reactivity of RDR Compound II.

| Sample | Filter | Dwell Time | Donor and Receptor Dmin | Dmax | SPD1 | Receptor Dmin | Dmax |
|---|---|---|---|---|---|---|---|
| RDR II (A) | Yes | 40 sec | R 0.16 | 0.26 | | | |
| | | | G 0.38 | 0.47 | | 0.16 | 0.19 |
| | | | B 2.01 | 2.09 | | 0.44 | 0.50 |
| | No | 30 sec | R 0.10 | 0.24 | | | |
| | | | G 0.32 | 0.47 | | 0.17 | 0.19 |
| | | | B 1.96 | 2.09 | | 0.46 | 0.51 |
| | No | 40 sec | R 0.14 | 0.31 | | | |
| | | | G 0.37 | 0.53 | | 0.16 | 0.19 |
| | | | B 1.91 | 2.09 | | 0.42 | 0.49 |
| RDR II (A) and P | Yes | 40 sec | R 0.26 | 0.54 | 2.97 | | |
| | | | G 0.51 | 1.03 | 2.35 | 0.19 | 0.25 |
| | | | B 2.01 | 2.26 | | 0.49 | 0.58 |
| | No | 30 sec | R 0.27 | 0.53 | 3.02 | | |
| | | | G 0.51 | 0.98 | 2.23 | 0.18 | 0.21 |
| | | | B 1.98 | 2.22 | | 0.49 | 0.61 |
| | No | 40 sec | R 0.27 | 0.56 | 2.82 | | |
| | | | G 0.52 | 1.01 | 2.33 | 0.17 | 0.21 |
| | | | B 2.01 | 2.23 | | 0.45 | 0.94 |
| RDR II (B) | Yes | 30 sec | R 0.23 | 0.34 | | | |
| | | | G 0.78 | 0.78 | | 0.20 | 0.21 |
| | | | B 2.47 | 2.65 | | 0.58 | 0.60 |
| | No | 20 sec | R 0.22 | 0.35 | | | |
| | | | G 0.55 | 0.78 | 3.12 | 0.22 | 0.25 |
| | | | B 2.50 | 2.64 | | 0.63 | 0.76 |
| | No | 30 sec | R 0.19 | 0.41 | 3.51 | | |
| | | | G 0.52 | 0.89 | 2.93 | 0.20 | 0.24 |
| | | | B 2.45 | 2.62 | | 0.58 | 0.70 |
| RDR II (B) and P | Yes | 30 sec | R 0.25 | 0.55 | 3.08 | | |
| | | | G 0.63 | 1.21 | 2.31 | 0.21 | 0.28 |
| | | | B 2.46 | 2.52 | | 0.58 | 0.78 |
| | No | 20 sec | R 0.15 | 0.43 | 2.92 | | |
| | | | G 0.46 | 0.87 | 2.74 | 0.22 | 0.27 |
| | | | B 2.28 | 2.43 | | 0.66 | 0.83 |

-continued

| Sample | Filter | Dwell Time | Donor and Receptor Dmin | Donor and Receptor Dmax | Donor and Receptor SPD1 | Receptor Dmin | Receptor Dmax |
|---|---|---|---|---|---|---|---|
| | No | 30 sec | R 0.43 | 0.69 | 3.12 | | |
| | | | G 1.11 | 1.42 | | 0.22 | 0.30 |
| | | | B 2.48 | 2.54 | | 0.65 | 0.92 |

Example 9

Differential Diffusion

A receptor layer was prepared by coating 101 micron vesicular polyester base at 3 mil wet thickness with a 15% solution of VYNS™-3 in 3:1 methyl ethyl ketone:toluene and dried at 80° C. for 5 minutes. Onto this was coated an emulsion layer prepared as follows: unhalogenized soap A [10 g, prepared by stirring together half-soap homogenate (11% w/w in ethanol, 100 g), Butvar™ B-72 polyvinyl butyral (10% w/w in ethanol, 150, available from Monsanto, St. Louis, Mo.) and fluoroaliphatic polyester surfactant Fluorad™ FC-431 (0.75 g, available from Minnesota Mining and Manufacturing, St. Paul, Minn.) for 15 minutes] was mixed with a solution of the test compound (as specified in the following table), coated onto the receptor, and dried at 70° C. for 6 minutes.

In the two examples (coatings 2 and 3 shown in the following table), the emulsion layer was coated on to polyester base that had been pretreated with Fluorad™ FC-431, dried, laminated to the receptor layer by means of a heated roller device, and the FC 431-treated base peeled off and discarded. Specifically, a 3M Matchprint™ laminator was used with the upper and lower rollers set at the standard temperature settings for the Matchprint™ proofing process.

The details of test compound, solvent, and wet coating thickness are given in the following table.

| Coating No. | Test Compound | Weight (mg) | THF (mL) | Methanol (mL) | Wet Orifice |
|---|---|---|---|---|---|
| 1 | RDR XII | 122 | 2 | 1 | 3 mil |
| 2 | RDR XI | 140 | Toluene 4 mL | | 4 mil |
| 3 | RDR VII | 126 | 4 | 0 | 3.5 mil |
| 4 | RDR X | 144 | 7 | 1 | 4 mil |

Samples of coatings 1–4 were processed at 135° C. for varying times on a hot block and cut into 1 inch squares. Half the squares were dissolved in 4:1 methyl ethyl ketone:methanol, suitably diluted and the UV/visible spectrum measured. The other half had the emulsion layer removed and the receptor only treated as before. This allowed the percentage of test compound remaining in the silver layer to be calculated. The percentage dye left in the emulsion layer for each coating ranged from 94.3 to 98.7 after 30 seconds. These results showed that the redox-dye-releasing compounds of the invention show very little tendency to diffuse out of the emulsion layer either during coating or during thermal processing. Attempts were made to get equivalent results for polymeric RDR Compound XIII. These failed because processing caused the emulsion layer to stick to the receptor making it impossible to peel them apart; however, it is believed that the use of different polymers in the receptor layer and/or different surfactants (especially fluorinated surfactants) in the receptor layer, or in the emulsion layer, or both, would solve this problem.

Imaging

Soap B [10 g, prepared by adding to half-soap homogenate (11% w/w in ethanol, 55 g), ethanol (60 g), and Butvar™ B-72 polyvinyl butyral (10% w/w in n-propanol, 40 g), which was then halogenized by adding 0.375 mL of mercuric bromide in ethanol (0.72 g/5 mL), stirring for 1 hour, then adding 0.625 mL of zinc bromide in ethanol (0.45 g/5 mL), and stirring for a further 2 hours. Butvar™ B-72 polyvinyl butyral (10% w/w in n-propanol, 130 g) was added and the mixture stirred for 2 hours before finally adding Fluorad™ FC-431 (0.75 g). The red sensitizing dye used in Example 1 was added in varying quantities as a 0.01% w/w solution in ethanol, and the mixture was held at ambient temperature in the dark for varying periods, as described below. To the resultant mixture was added phthalazinone (0.1 g), a development accelerator (varying amount), and the test compound in tetrahydrofuran (3 mL) and methanol (0.5 mL). This was coated at 3 mil wet orifice onto the receptor as described in Example 3 and dried at 70° C. for 6 minutes. The details of the hydrazide compound, development accelerator, and sensitization are given in the following table.

| Coating No. | Test Compound | Weight (mg) | Development Accelerator | Weight (mg) | Sensitization |
|---|---|---|---|---|---|
| 5 | RDR XII | 122 | None | — | 0.2 mL/2 hours |
| 6 | RDR VIII | 126 | None | — | 0.2 mL/2 hours |
| 7 | RDR VIII | 126 | Hf[a)] | 50 | 0.2 mL/2 hours |
| 8 | RDR VIII | 126 | Hf[a)] | 100 | 0.2 mL/2 hours |
| 9 | RDR VII | 126 | None | — | 0.2 mL/overnight + 0.6 mL/2 hours |
| 10 | RDR VIII | 126 | Ts[c)] | 50 | 0.2 mL/overnight + 0.6 mL/2 hours |
| 11 | RDR VIII | 126 | Bd[b)] + Ts[c)] | 50 50 | 0.2 mL/overnight + 0.6 mL/2 hours |

[a)]Hf = Hydroxyfluorenone
[b)]Bd = Benzhydrol
[c)]Ts = $N^2$-tosylbenzhydrazide Samples of coatings 5 and 9 were imaged on an EG&G sensitometer using a 0–3 wedge for $4\times10^{-3}$ seconds to red light (Wratten #25 filter) before processing on a hot block set at 150° C. The emulsion layer was peeled off and the resulting image measured on an X-Rite densitometer system equipped with a blue filter. The results are shown below.

| Coating Number | Process Time (seconds) | Dmin | Dmax |
|---|---|---|---|
| 5 | 20 | 0.60 | 1.23 |
| 9 | 30 | 0.60 | 1.30 |

Coatings 6, 7, 8, 10, and 11 were imaged similarly to coatings 5 and 9 except that exposure was done with white light. Processing was carried out at varying temperatures and times. The results are presented below.

| Coating Number | Process Temp (°C.) | Process Time (secs) | Dmin | Dmax |
|---|---|---|---|---|
| 6 | 150 | 60 | Faint Image | |
| 7 | 150 | 10 | 0.55 | 0.75 |
| | | 29 | 0.57 | 1.08 |
| | | 30 | 0.61 | 1.36 |
| | | 45 | 0.61 | 1.67 |
| 8 | 150 | 10 | 0.53 | 0.83 |
| | | 20 | 0.57 | 1.34 |
| | | 30 | 0.62 | 1.62 |
| | | 40 | 0.87 | 1.68 |
| 10 | 150 | 5 | 0.60 | 1.00 |
| | | 10 | 0.73 | 1.38 |
| | | 15 | 0.94 | 1.65 |
| | | 20 | 1.33 | 1.86 |
| 10 | 135 | 10 | 0.51 | 0.67 |
| | | 20 | 0.55 | 0.93 |
| | | 30 | 0.61 | 1.10 |
| | | 45 | 0.65 | 1.35 |
| | | 60 | 0.75 | 1.55 |
| | | 90 | 0.86 | 1.72 |
| 11 | 135 | 10 | 0.50 | 0.67 |
| | | 20 | 0.52 | 0.86 |
| | | 30 | 0.60 | 1.11 |
| | | 45 | 0.65 | 1.40 |
| | | 60 | 0.73 | 1.60 |
| | | 90 | 1.05 | 1.94 |

Also, the addition of a second hydrazide or development accelerator gave improved performance with either shorter processing times or lower processing temperatures. The experiment was repeated using the polymeric hydrazides RDR XI or XIII, but the inability to separate the silver layer from the receptor layer meant that the transferred image density could not be measured. A silver image was, however, visible indicating that oxidation of the hydrazide did occur. Further, it is believed that this separation problem could be remedied as discussed above.

These experiments show that the series of hydrazides disclosed herein, both monomeric and polymeric, have low diffusibility in Dry Silver systems. On imaging and processing, they have been shown to cleave and the dye moiety migrate preferentially to an image receiving layer.

Reasonable modifications and variations are possible from the foregoing disclosure without departing from either the spirit or scope of the present invention as defined by the claims.

The complete disclosures of all publications, patents, and patent applications listed herein are incorporated by reference. The foregoing detailed description and examples have been given for clarity of understanding only. No unnecessary limitations are to be understood therefrom. The invention is not limited to the exact details shown and described, for variations obvious to one skilled in the art will be included within the invention defined by the claims.

What is claimed is:

1. A photothermographic element comprising a support bearing at least one heat-developable, photosensitive, image-forming photothermographic emulsion layer comprising:

(a) a photosensitive silver halide;

(b) a non-photosensitive, reducible source of silver;

(c) a reducing agent for the non-photosensitive, reducible silver source; and (d) a binder;

wherein the reducing agent comprises a hydrazide redox-dye-releasing compound of the general formulae:

$$R^1\text{+}C(O)-NH-NH-SO_2-X-D]_n \text{ or}$$

$$[D-X-C(O)-NH-NH-SO_2\text{+}_n R^2$$

wherein: D represents a chromophore of a thermally mobile dye; X represents a single bond or a divalent linking group; $R^1$ and $R^2$ independently an organic group; and $n \geqq 1$.

2. The photothermographic element of claim 1 wherein $R^1$ and $R^2$ independently represent a ballasting group.

3. The photothermographic element of claim 1 wherein n=1.

4. The photothermographic element of claim 1 wherein n>1.

5. The photothermographic element of claim 1 wherein $R^1$ and $R^2$ are each independently selected from the group consisting of an alkyl and an alkenyl group of up to 20 carbon atoms; an alkoxy group of up to 20 carbon atoms; an aryl group of up to 20 carbon atoms; an alkaryl group of up to 20 carbon atoms; an aralkyl group of up to 20 carbon atoms; an aryloxy group of up to 20 carbon atoms; a non-aromatic heterocyclic ring group containing up to 6 ring atoms; an aromatic heterocyclic ring group containing up to 6 ring atoms; an alicyclic ring group comprising up to 6 ring carbon atoms; a fused ring group comprising up to 14 ring atoms; and a bridging group comprising up to 14 ring atoms.

6. The photothermographic element of claim 1 wherein D is the chromophore of an azo dye, azomethine dye, azamethine dye, anthraquinone dye, naphthoquinone dye, styryl dye, nitro dye, benzylidene dye, oxazine dye, diazine dye, thiazine dye, ketazine dye, imidazole dye, indoaniline dye, merocyanine dye, benzodifuranone dye, quinoline dye, indophenol dye, indoanaline dye, or a triphenylmethane dye.

7. The photothermographic element of claim 1 further including a development accelerator.

8. The photothermographic element of claim 7 wherein the development accelerator comprises an electron transfer agent.

9. The photothermographic element of claim 7 wherein the development accelerator comprises a radical scavenger.

10. The photothermographic element of claim 7 wherein the development accelerator comprises a hydrazide codeveloper.

11. A photothermographic element comprising a support bearing at least one heat-developable, photosensitive, image-forming photothermographic emulsion layer comprising:

(a) a photosensitive silver halide;

(b) a non-photosensitive, reducible source of silver;

(c) a reducing agent for the non-photosensitive, reducible silver source; and (d) a binder;

wherein the reducing agent comprises a hydrazide redox-dye-releasing compound of the general formulae:

$$R^1+C(O)-NH-NH-SO_2-X-D]_n \text{ or}$$

$$[D-X-C(O)-NH-NH-SO_2]_n-R^2$$

wherein: D represents a chromophore of a thermally mobile dye; X represents a divalent linking group; $n \geqq 1$; and $R^1$ and $R^2$ are each independently selected from the group consisting of a ballasting group; an alkyl or alkenyl group of up to 20 carbon atoms; an alkoxy group of up to 20 carbon atoms; an aryl group of up to 20 carbon atoms; an alkaryl group of up to 20 carbon atoms; an aralkyl group of up to 20 carbon atoms; an aryloxy group of up to 20 carbon atoms; a non-aromatic heterocyclic ring group containing up to 6 ring atoms; an aromatic heterocyclic ring group containing up to 6 ring atoms; an alicyclic ring group comprising up to 6 ring carbon atoms; a fused ring group comprising up to 14 ring atoms; and a bridging group comprising up to 14 ring atoms.

12. The photothermographic element of claim 11 wherein the hydrazide redox-dye-releasing compound is $R^1-C(O)-NH-NH-SO_2-X-D$.

13. The photothermographic element of claim 11 wherein $R^1$ and $R^2$ independently represent a ballasting group.

14. The photothermographic element of claim 11 wherein the ballasting group comprises one or more hydroxy moieties.

15. The photothermographic element of claim 11 further including a development accelerator.

16. The photothermographic element of claim 15 wherein the development accelerator comprises phenidone.

17. The photothermographic element of claim 15 wherein the development accelerator comprises hydroxyfluorenone.

18. The photothermographic element of claim 15 wherein the development accelerator comprises $N^2$-tosylbenzhydrazide.

19. The photothermographic element of claim 15 wherein the development accelerator comprises benzhydrol.

20. A method of producing an image comprising:

(a) imagewise exposing an element comprising a support bearing at least one heat-developable, photosensitive, image-forming photothermographic emulsion layer comprising:

(i) a photosensitive silver halide;

(ii) a non-photosensitive, reducible source of silver;

(iii) a reducing agent for the non-photosensitive, reducible silver source; and (iv) a binder;

wherein the reducing agent compound comprises a hydrazide redox-dye-releasing compound of the formulae:

$$R^1-[-C(O)-NH-NH-SO_2-X-D]_n \text{ or } [D-X-C(O)-NH-NH-SO_2-]_n-R^2$$

wherein: D represents a chromophore of a thermally mobile dye; X represents a single bond or a divalent linking group; $R^1$ or $R^2$ independently represent an organic group; and $n \geqq 1$, and (b) developing the element to form an image.

* * * * *